US006289193B1

(12) United States Patent
Ban et al.

(10) Patent No.: US 6,289,193 B1
(45) **Date of Patent: *Sep. 11, 2001**

(54) TONER SUPPLY CONTAINER AND TONER RECEIVING CONTAINER FOR RECEIVING TONER FROM SAME

(75) Inventors: Yutaka Ban, Tokyo; Michiaki Endoh, Toride; Hideaki Kosasa, Kashiwa; Fumio Tazawa, Numazu, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/338,517

(22) Filed: Jun. 23, 1999

(30) Foreign Application Priority Data

Jun. 24, 1998 (JP) ..... 10-193683

(51) Int. Cl.[7] ..... G03G 15/08
(52) U.S. Cl. ..... 399/258; 399/260
(58) Field of Search ..... 399/258, 260, 399/102, 103, 105, 106; 222/DIG. 1

(56) References Cited

U.S. PATENT DOCUMENTS

| | | | |
|---|---|---|---|
| 4,981,218 | 1/1991 | Ban et al. | 206/633 |
| 5,268,722 | 12/1993 | Ikkata et al. | 355/260 |
| 5,351,728 | 10/1994 | Ban et al. | 141/364 |
| 5,579,101 | 11/1996 | Omata et al. | 355/260 |
| 5,682,579 * | 10/1997 | Nomura et al. | 399/258 X |
| 5,974,286 * | 10/1999 | Ban et al. | 399/106 |
| 6,014,536 * | 1/2000 | Ban et al. | 399/258 |

FOREIGN PATENT DOCUMENTS

| | | |
|---|---|---|
| 0 770 930 | 5/1997 | (EP) . |
| 4-336565 | 11/1992 | (JP) . |
| 6-27810 | 2/1994 | (JP) . |
| 9-120206 | 5/1997 | (JP) . |

OTHER PUBLICATIONS

Patent Abstracts of Japan, Kokai No. 05–333693.
Patent Abstracts of Japan, Kokai No. 06–27810.

* cited by examiner

*Primary Examiner*—Quana M. Grainger
(74) *Attorney, Agent, or Firm*—Fitzpatrick, Cella, Harper & Scinto

(57) ABSTRACT

A toner supplying container detachably mountable to an image forming apparatus includes a container body for accommodating toner, the container body being provided with an opening for permitting supply of the toner into a toner receiving container; a removable sealing member for sealing the opening, the sealing member is provided with a force applying portion for applying force for removing the sealing member from the opening; an elastic member urging the force applying portion from a predetermined position in the direction of removing the sealing member; a releasable locking member for releasably locking the force applying portion of the sealing member at the predetermined position against elastic force of the elastic member.

53 Claims, 19 Drawing Sheets

TONER SUPPLY CONTAINER AND TONER RECEIVING CONTAINER FOR RECEIVING TONER FROM SAME

FIELD OF THE INVENTION AND RELATED ART

The present invention relates to a toner supply container for replenishing toner into an image forming apparatus such as an electrophotographic copying machine or a printer, and a toner receiving container of an image forming apparatus for receiving the toner from the toner supply container.

Heretofore, toner in the form of fine particles is used as a developer in the image forming apparatus such as an electrophotographic copying machine or a printer. When the developer in a main assembly of the image forming apparatus is used, the toner is supplied into the image forming apparatus using a toner supply container. The toner is in the form of fine particles, and may be a one component toner or a two component toner.

Since the toner is very fine particles, it may scatter during the replenishing operation to contaminate the surroundings, and various proposals have been made about the toner supply container and the toner supply apparatus in view of this.

For example, a flange portion is formed in the main assembly of the container in the form of a box, and flexible film is welded on the flange portion to seal the portion. The film may be peeled off to unseal the container. Additional improvement has been made wherein the opening is provided with a shutter to permit resealing to prevent scattering of the small amount of the toner remaining and deposited on the inside of the toner supply container after the replenishment (Japanese Laid-open Patent Application No. HEI-4-336565).

On the other hand, as for the main assembly of the copying machine, the toner hopper or developing device (toner receiving device) for receiving the toner discharged from the toner supply container, is provided with a covering member for covering the opening for receiving the toner so as to accomplish reduction of the toner scattering and toner contamination and to prevent contamination with different kinds of toner (Japanese Laid-open Patent Application No. HEI-4-336565). In this proposal, the covering member of the toner receiving mounting is locked so as to be immovable unless a predetermined toner supply container is mounted.

With such a structure, unless the toner supply container is unsealed after the toner supply container is mounted assuredly to the toner receiving apparatus, the covering member or shutter of the toner receiving apparatus is not opened, so that toner is liable to scatter. In view of this, Japanese Laid-open Patent Application No. HEI-4-336565, a grip is fixed to an end of a flexible film, and the grip is mounted to the main assembly of the container. After it is mounted to the toner receiving apparatus, the covering member of the toner receiving apparatus is completely opened, and at this time, the grip is permitted to disengage from the main assembly of the container. When the grip is then pulled, the flexible film and the shutter are unsealed and opened. This requires two step operation for the unsealing.

Japanese Laid-open Patent Application No. HEI-9-120206 propouses that grip is fixed to the end of the flexible film, and the grip is mounted to the main assembly of the container, and by mounting the toner supply container to the toner receiving apparatus, the grip is disengaged in the upward direction. By pulling the grip, the three elements namely the flexible film, the shutter member a covering member or cover of the toner receiving apparatus are integrally opened, thus permitting one step opening action.

However, the conventional example involves the following problems.

With the structure of the Japanese Laid-open Patent Application No. HEI-4-336565, the unsealing operation is two step operation. The operator is not well notified that covering member should be opened after the toner supply container is mounted to the toner receiving apparatus.

According to Japanese Laid-open Patent Application No. HEI-9-120206, the unsealing operation is an one step operation, The disengagement of the grip results in the production of a force in a direction of mounting the toner supply container to the toner receiving container. If grip is moved upwardly, that is, in the opposite direction the toner supply container will be dismounted for the toner receiving container. An unskilled operator may misunderstand that grip is to be pulled up. The upward pulling is not prevented.

SUMMARY OF THE INVENTION

Accordingly, it is a principal object of the present invention to provide a toner supply container and a toner receiving container having the following features:

(1) unsealing of the toner supply container is enabled only after the toner supply container is assuredly mount ed to the toner receiving container;

(2) the unsealing direction of the grip is easily understood by the operator; and (3) by limiting t he grip pulling direction to a predetermined direction so that unsealing is smooth.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Figures illustrate the present invention.

DESCRIPTION OF THE PREFERRED EMBODIMENTS

Figure 1:
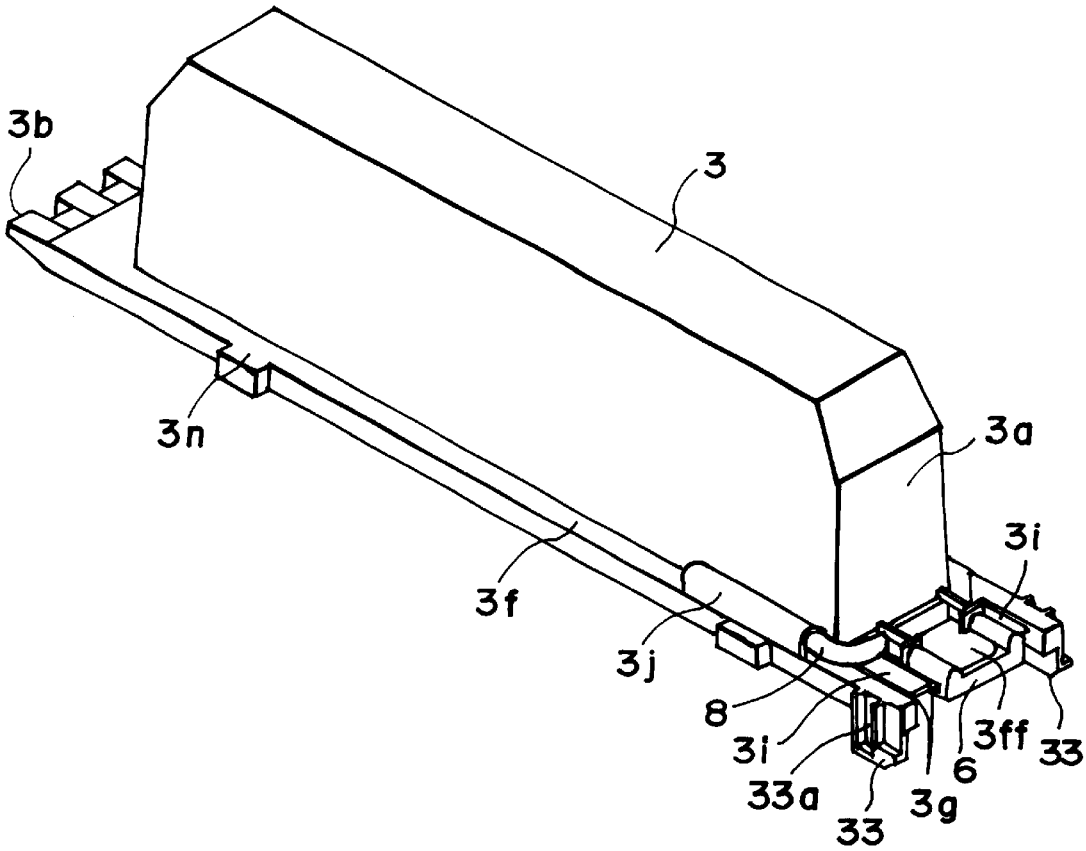
FIG. 1 is a perspective view of a developer supply container partly broken.
Figure 2:
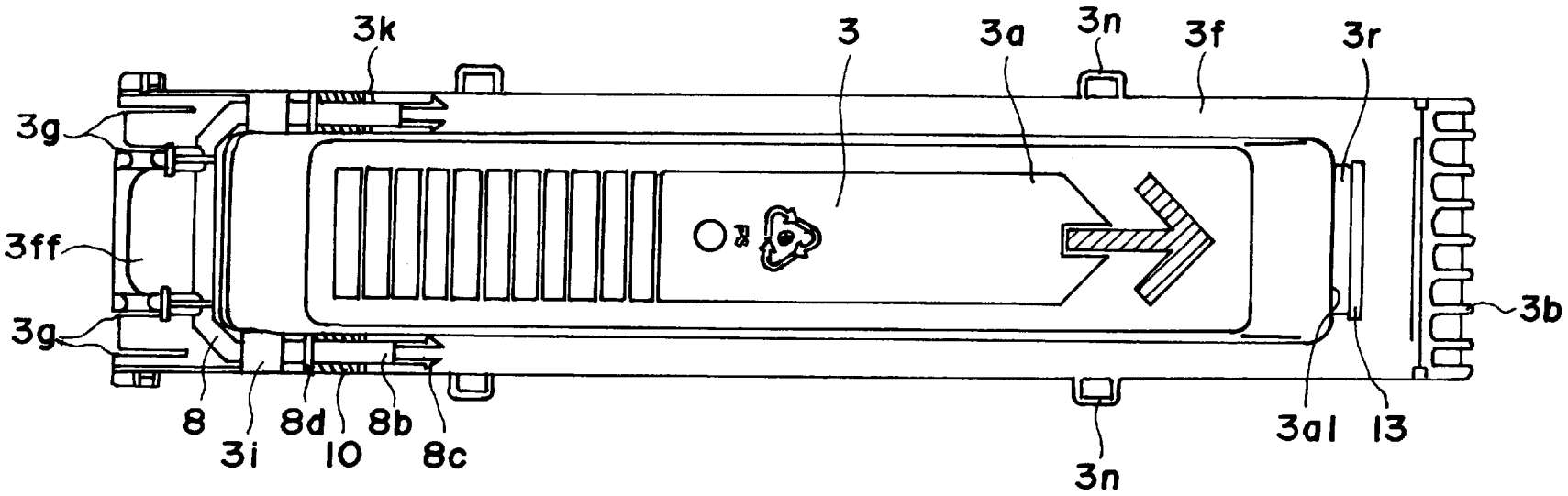
FIG. 2 is a top plan view of the container of FIG. 1.
Figure 3:
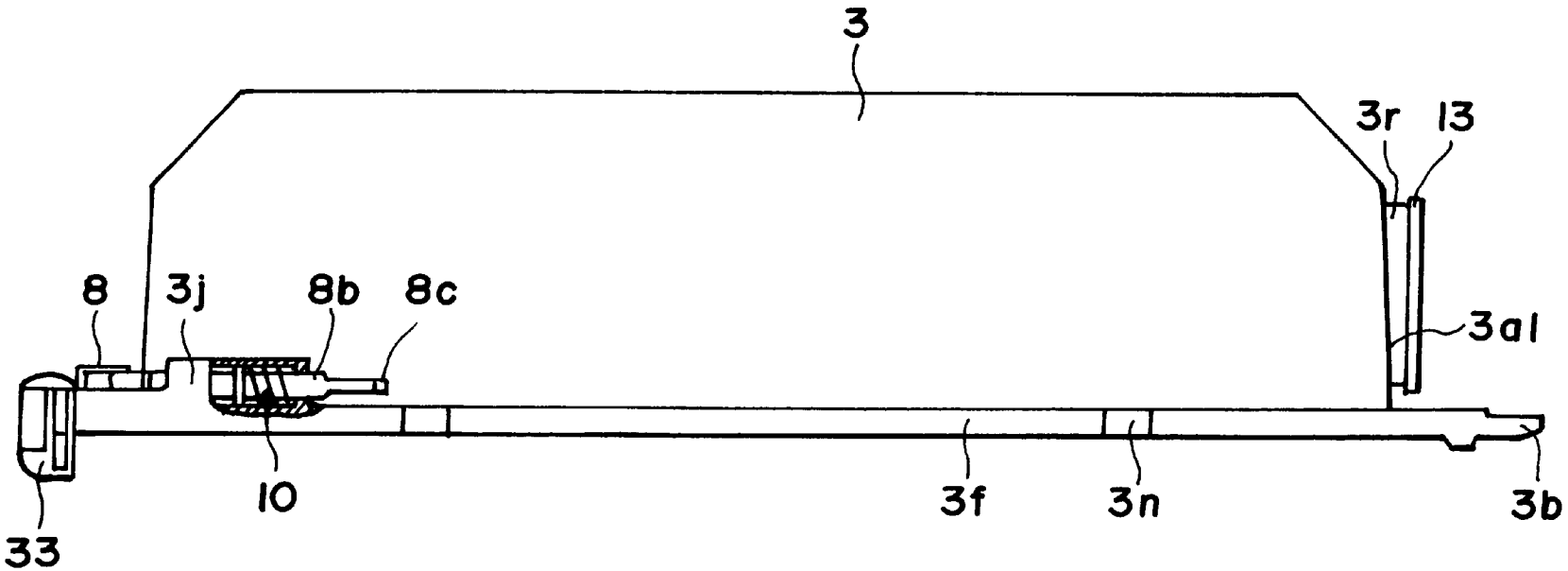
FIG. 3 is a side view of the container of FIG. 1, wherein a part thereof is a cross-section.
Figure 4:
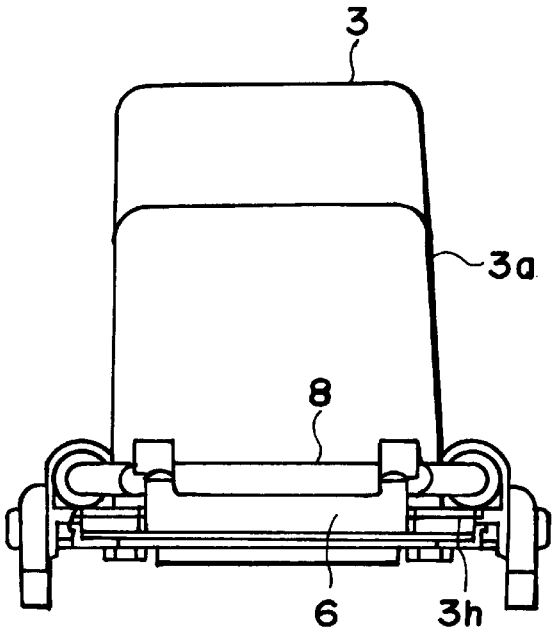
FIG. 4 is a front view of the container of FIG. 1.
Figure 5:
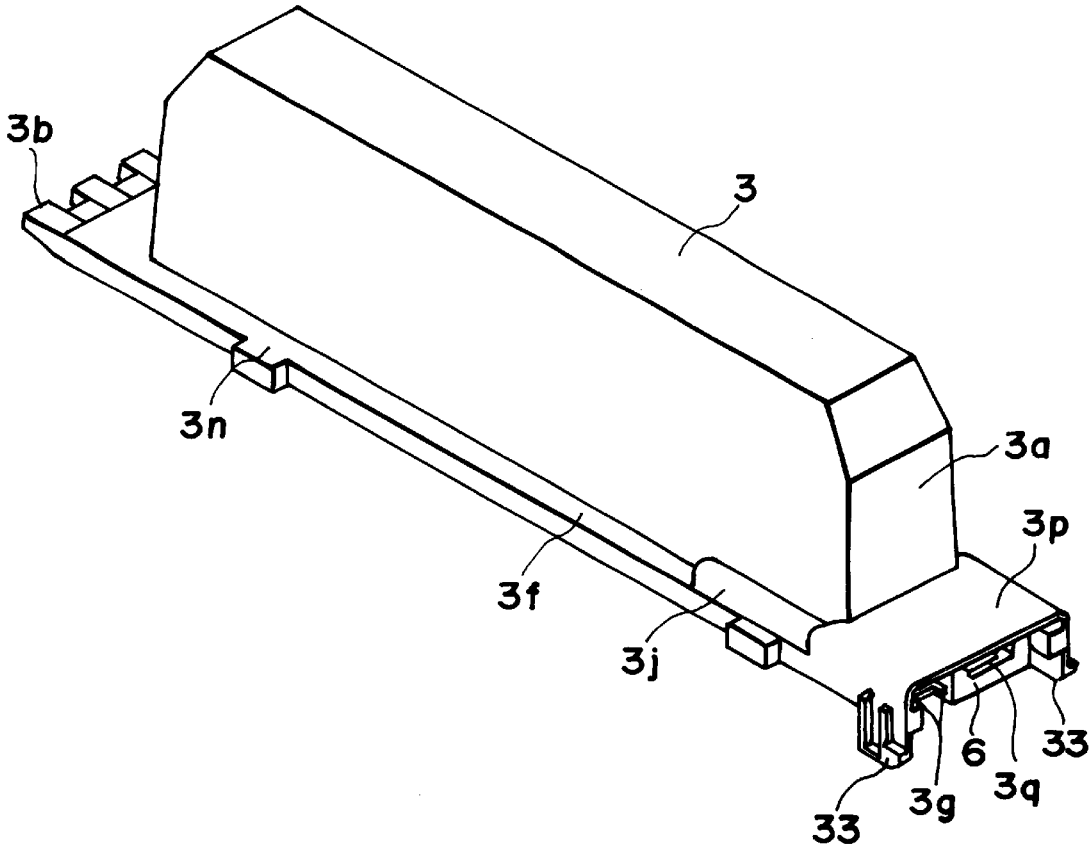
FIG. 5 is a perspective view of an outer appearance of a developer supply container.
Figure 6:
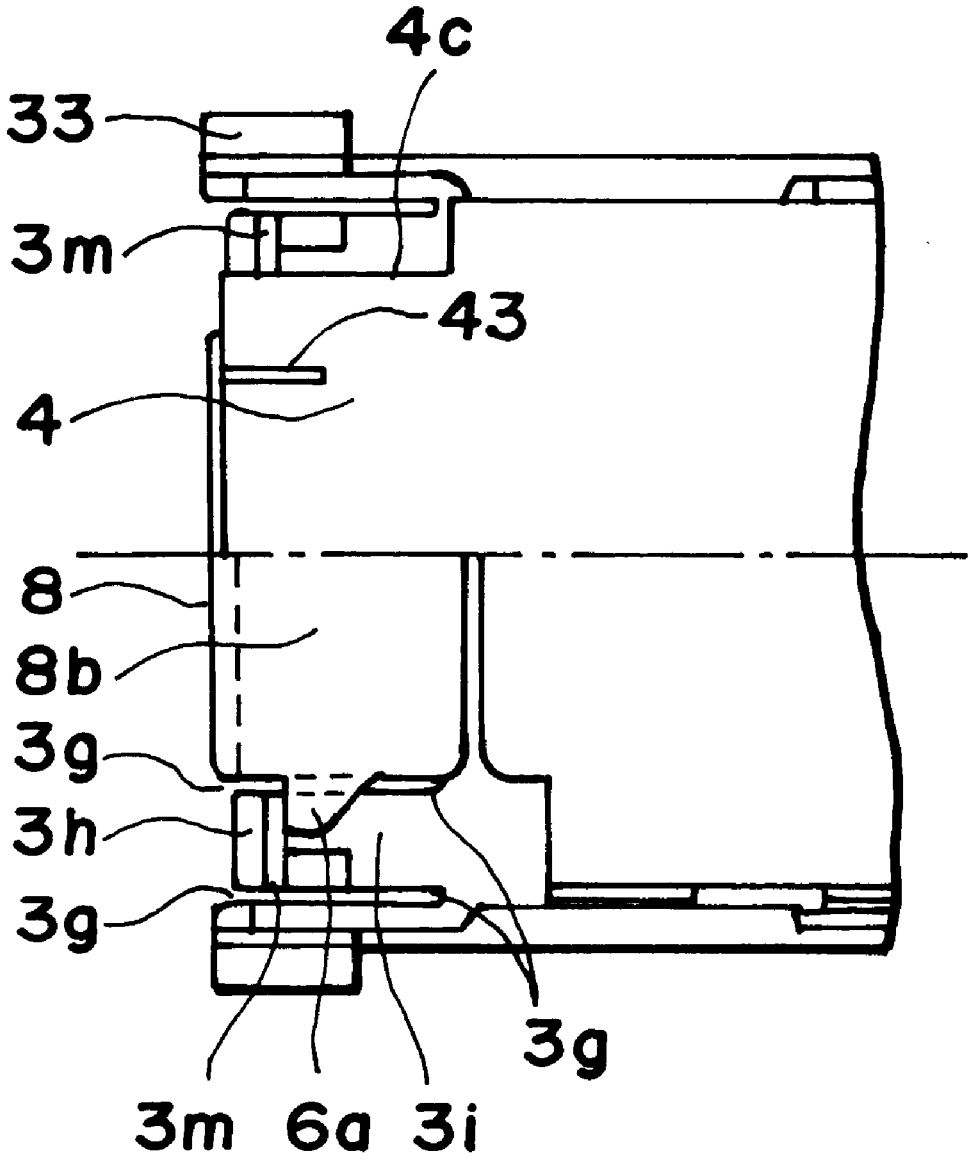
FIG. 6 is a bottom view of a front part of the developer supply container.
Figure 7:
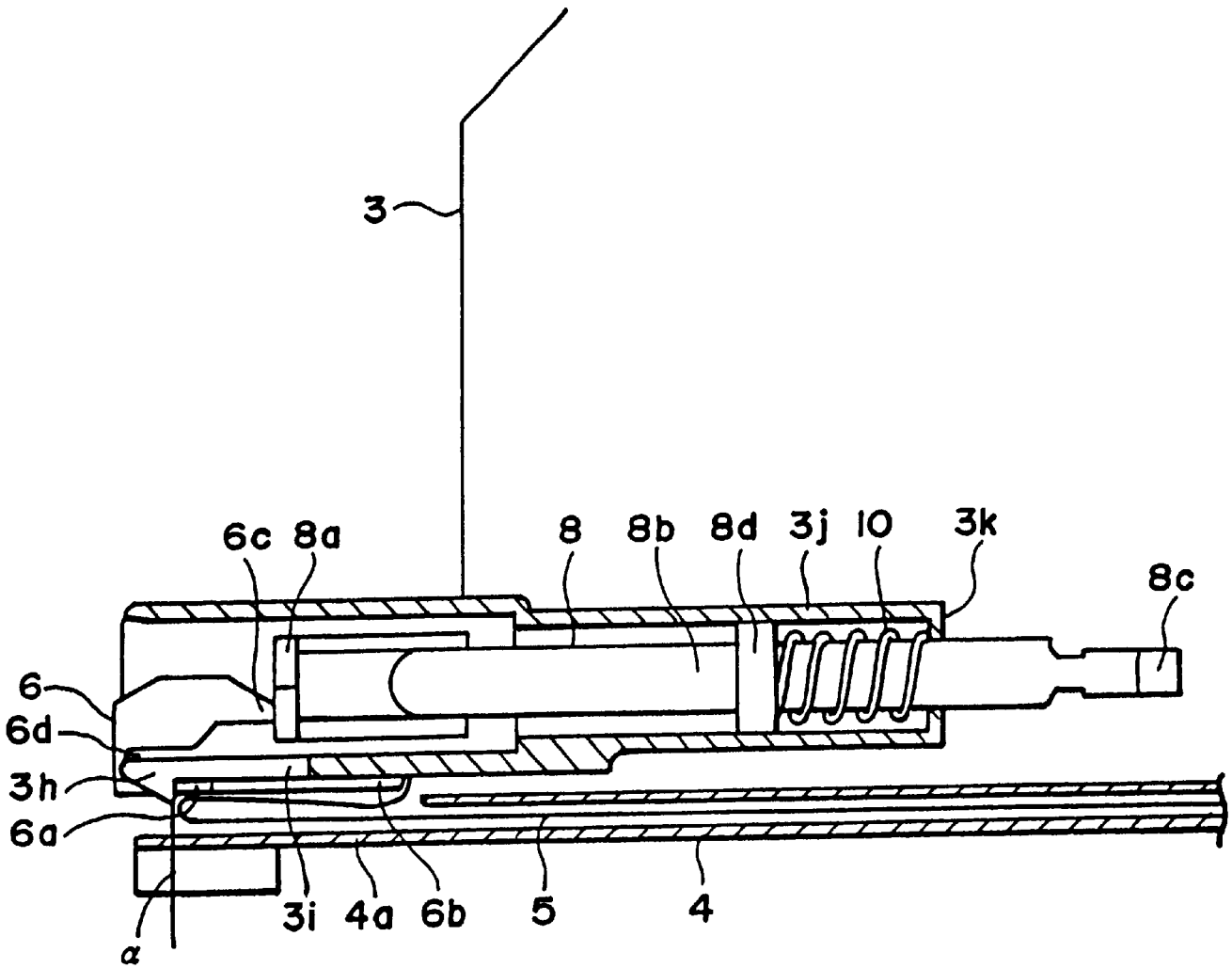
FIG. 7 is a longitudinal sectional view, in the sheet pulling direction, of the front part of the developer supply container.
Figure 8:
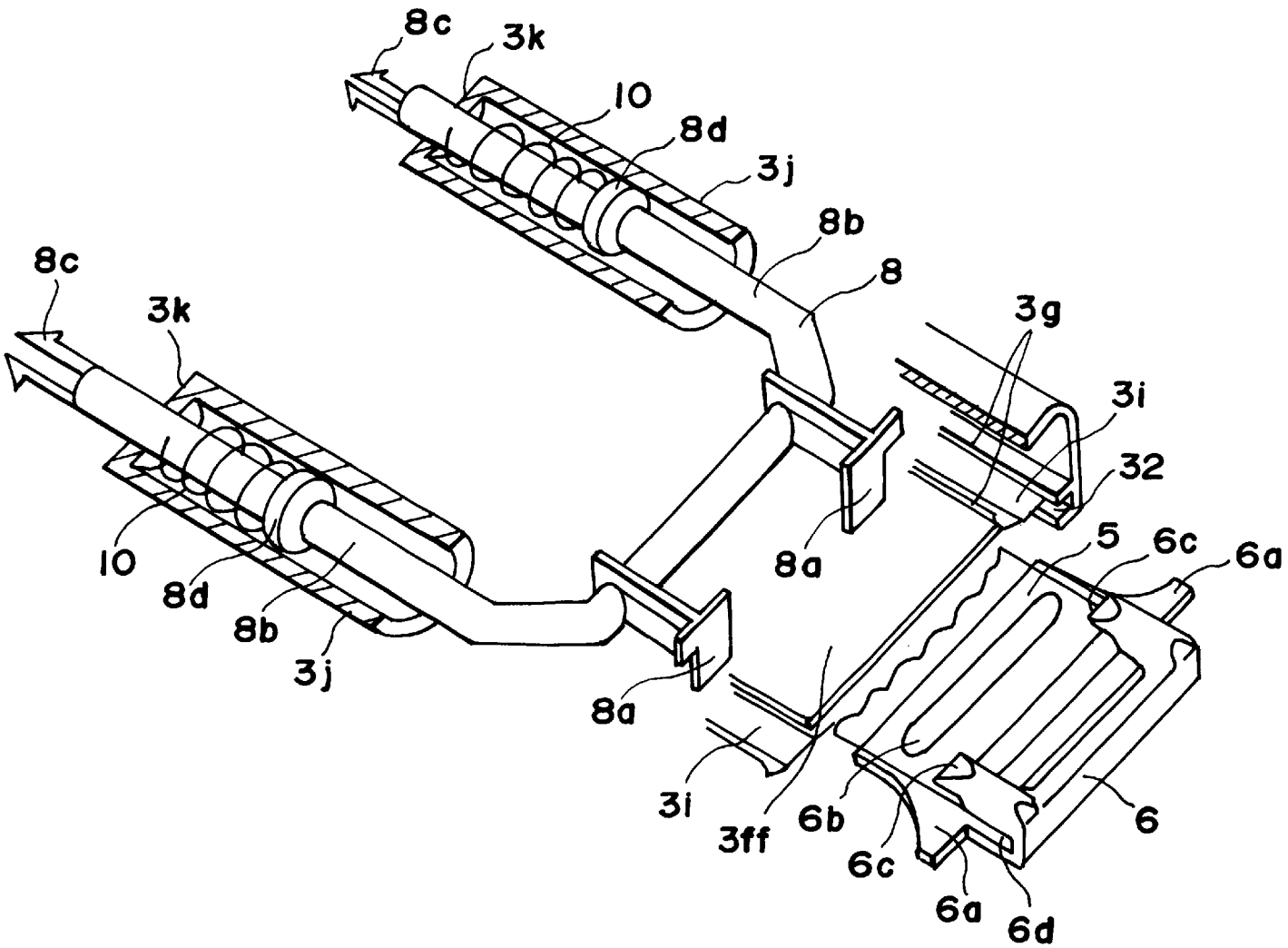
FIG. 8 is an exploded perspective view of a sheet pop-up device.
Figure 9:
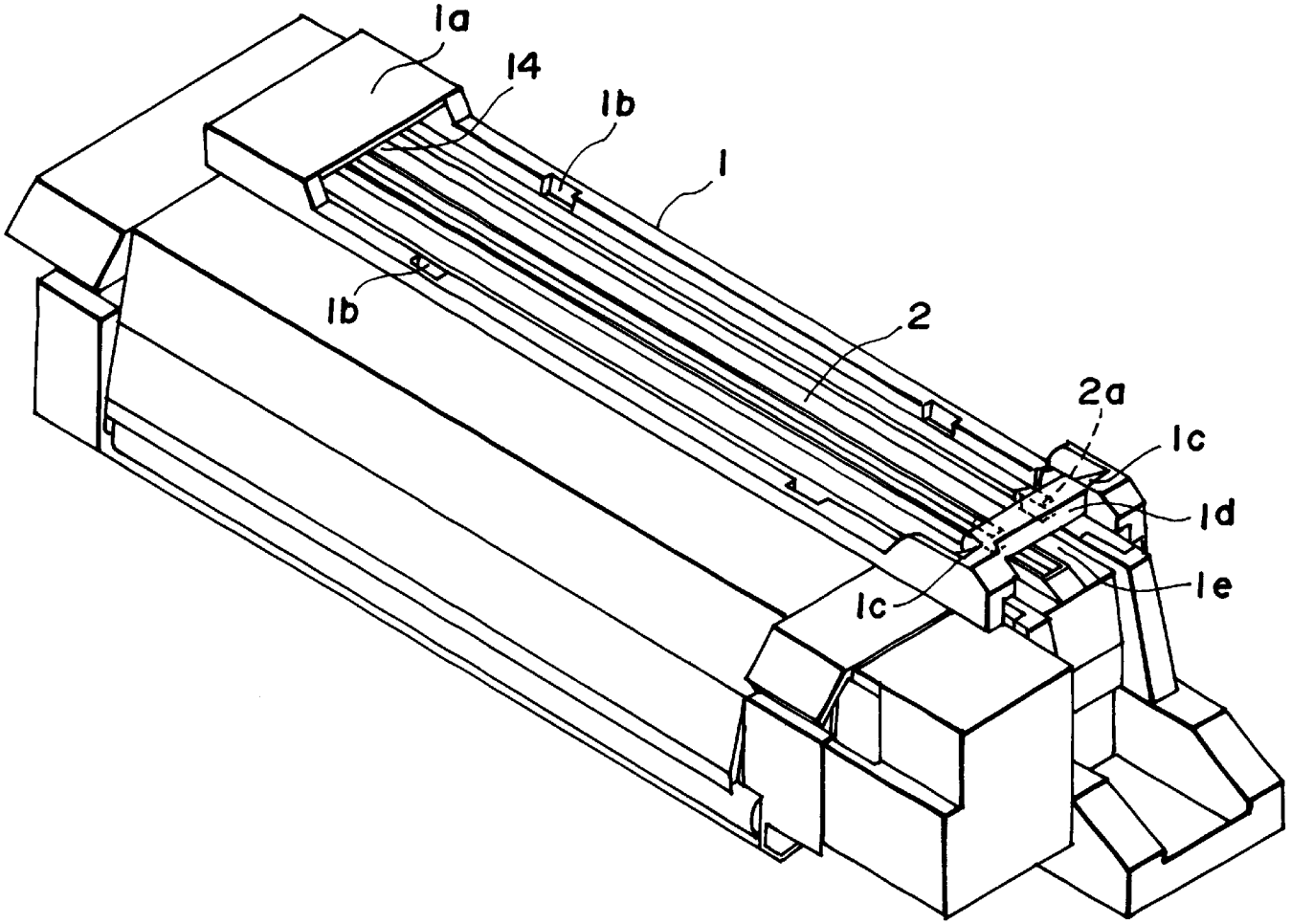
FIG. 9 is a perspective view of the developer receiving container.
Figure 10:
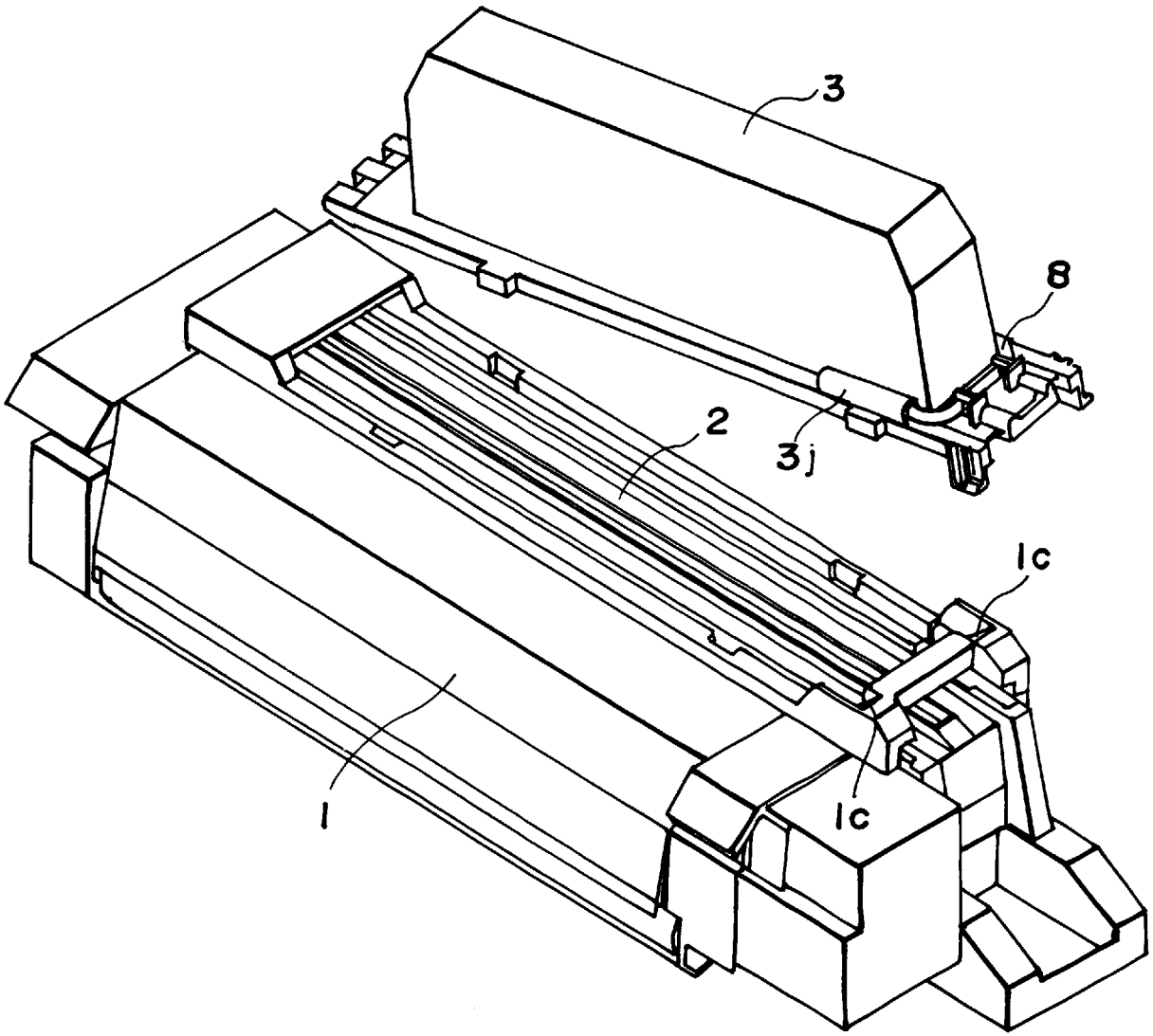
FIG. 10 is a perspective view illustrating mounting of the developer supply container to the developer receiving container.
Figure 11:
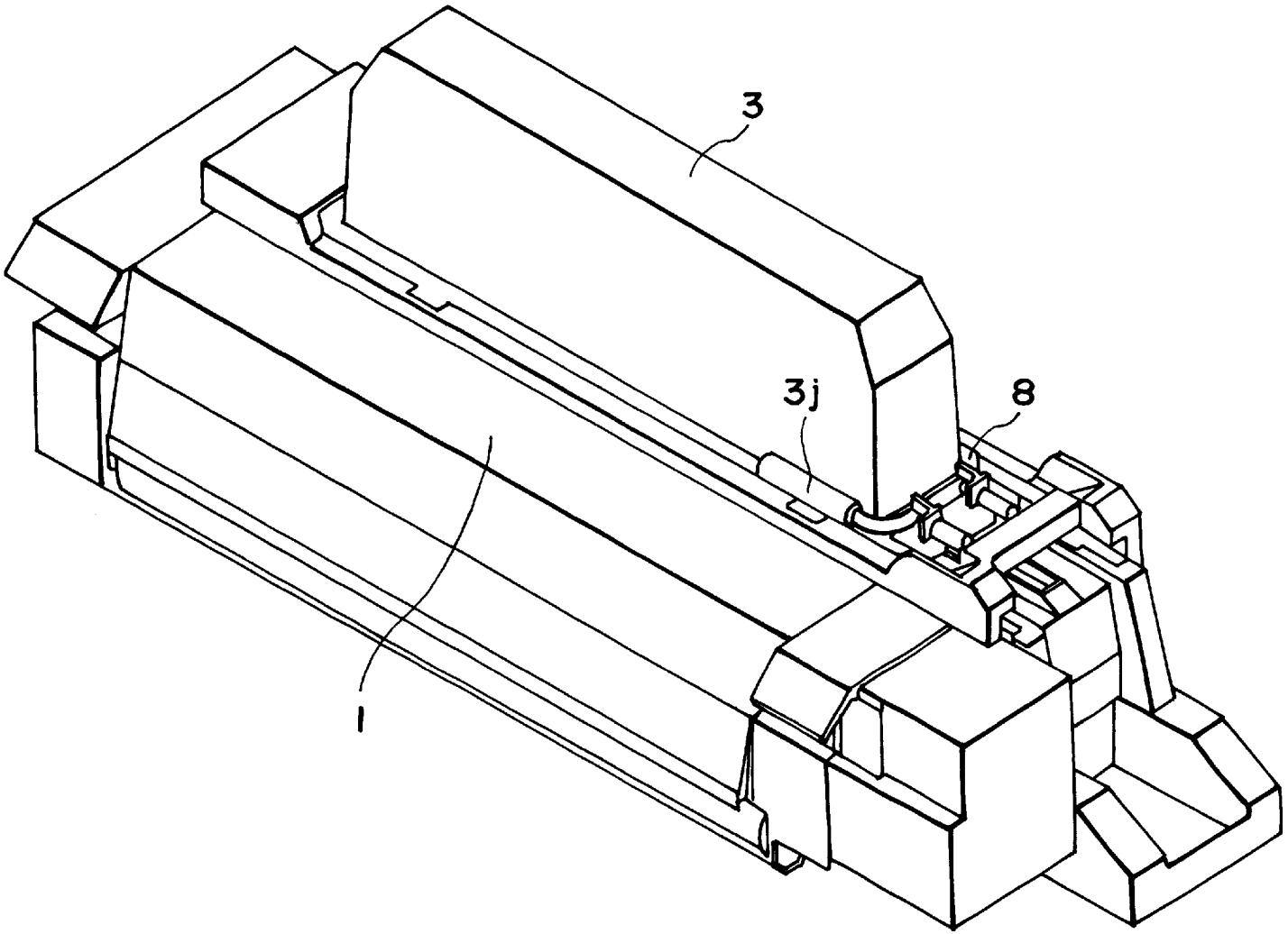
FIG. 11 is a perspective view illustrating a mounting state of the developer supply container to the developer receiving container.
Figure 12:
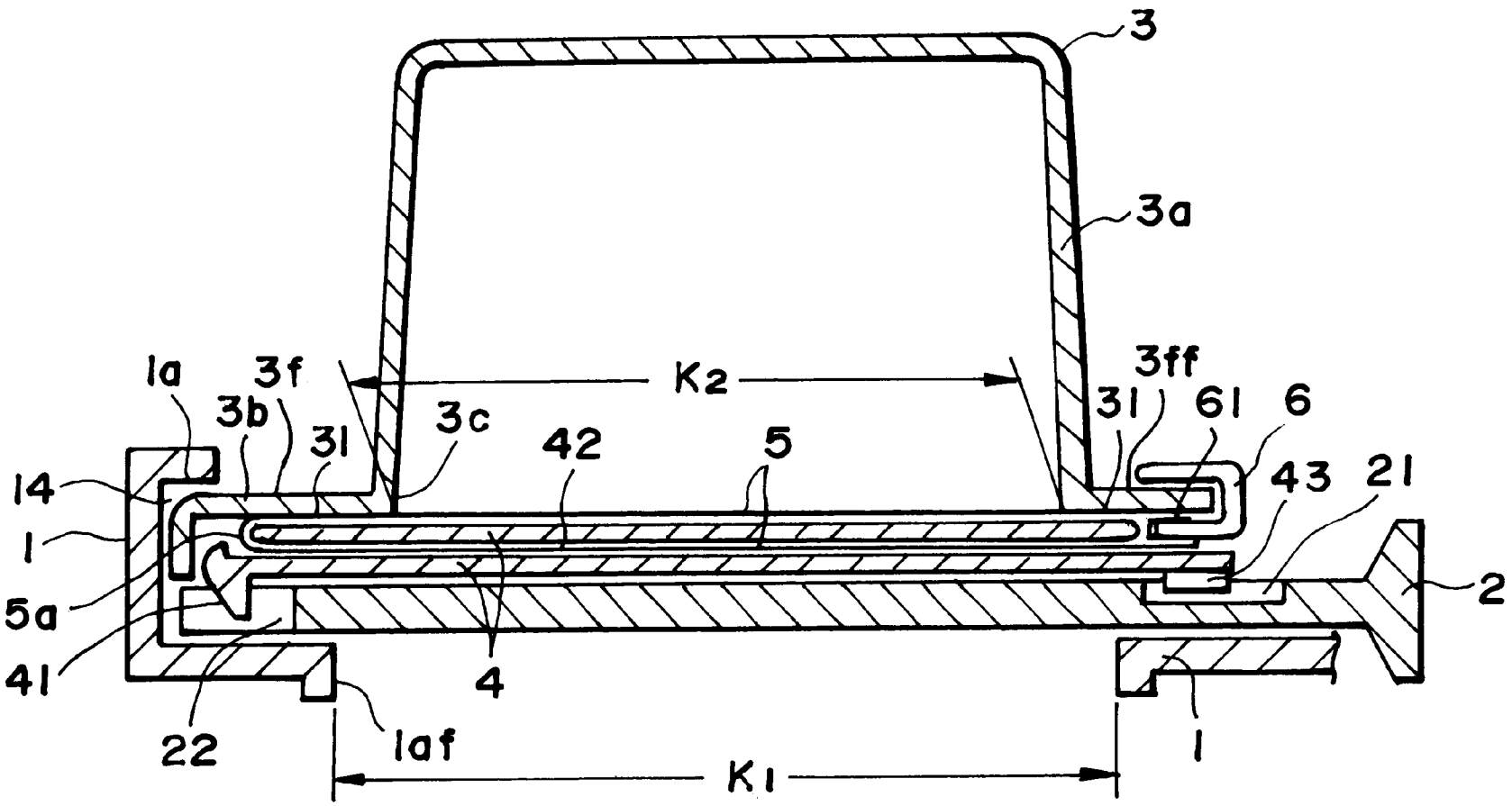
FIG. 12 is a longitudinal sectional view illustrating a mounting state of the developer supply container to the developer receiving container.
Figure 13:
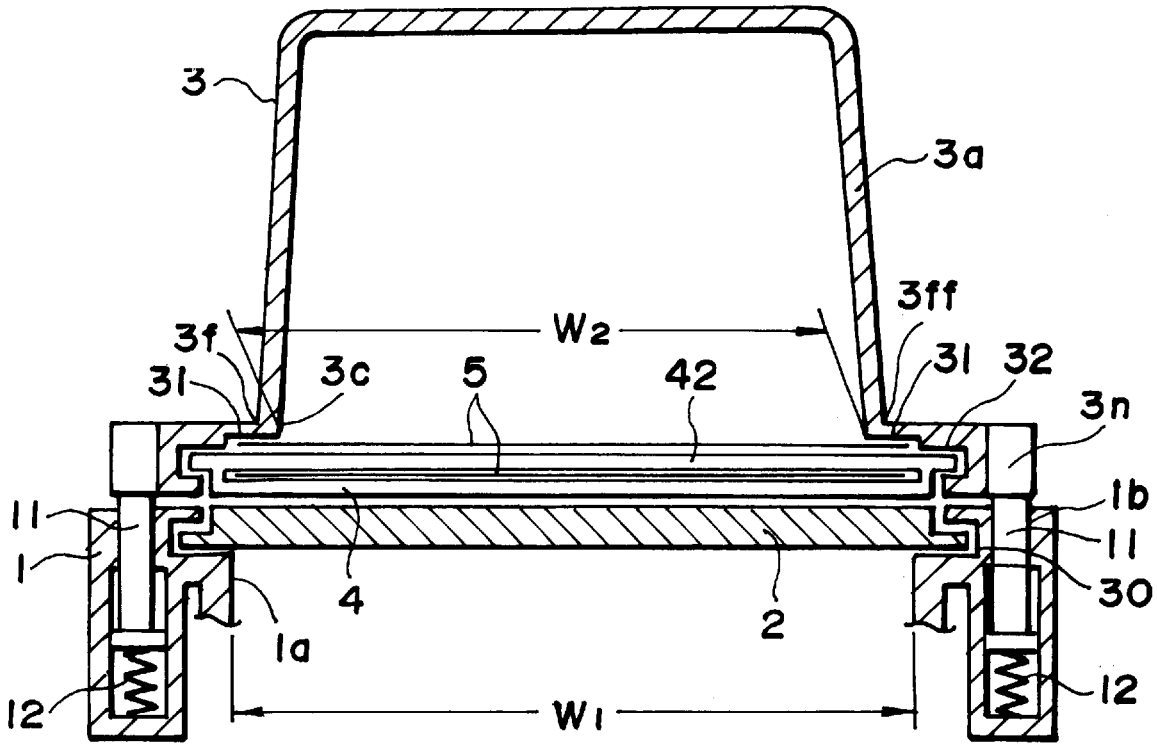
FIG. 13 is a longitudinal sectional view taken along a line perpendicular to the direction of FIG. 12.
Figure 16:
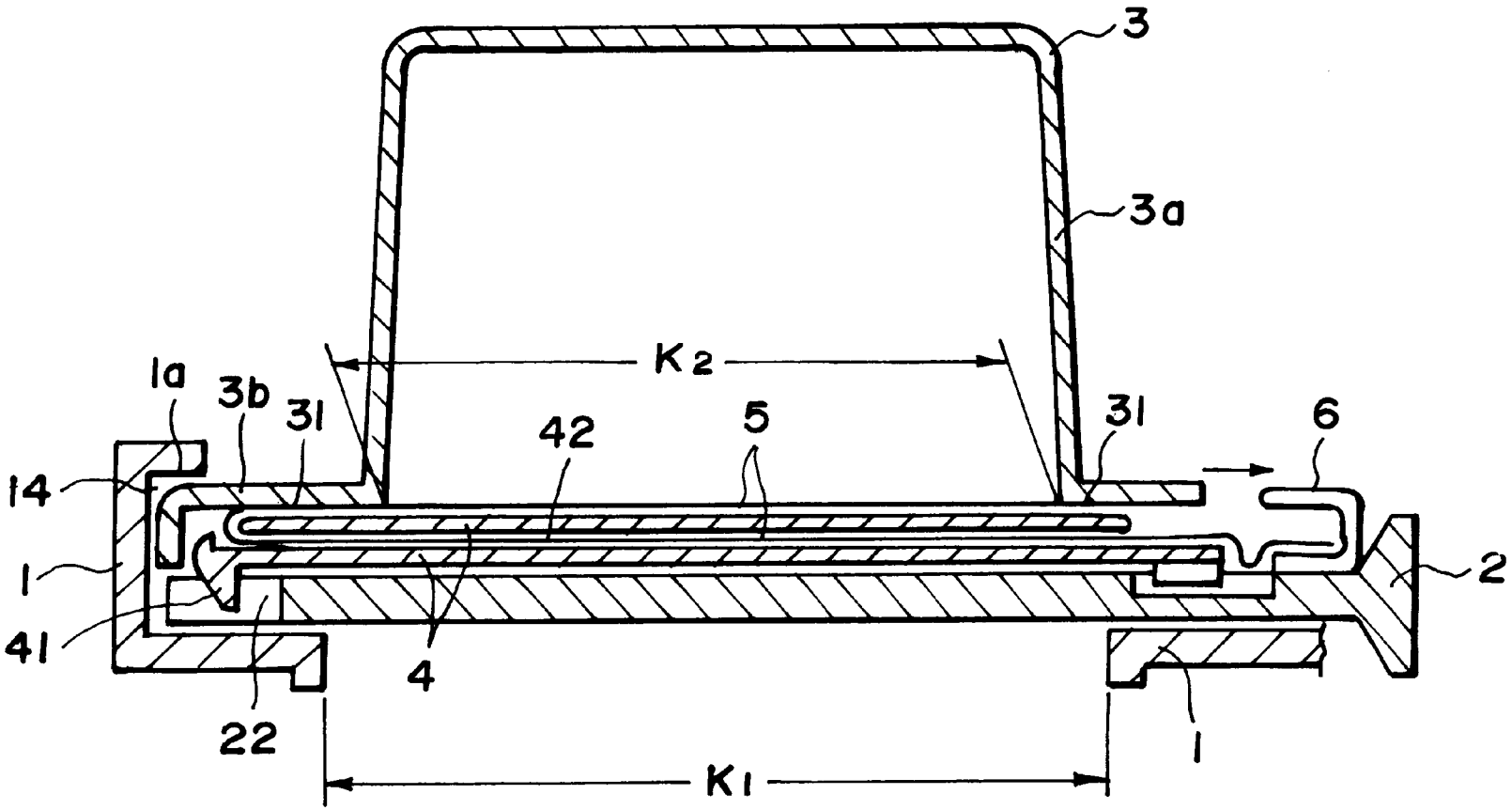
FIG. 16 is a longitudinal sectional view illustrating mounting of the developer supply container to the developer receiving container.
Figure 17:
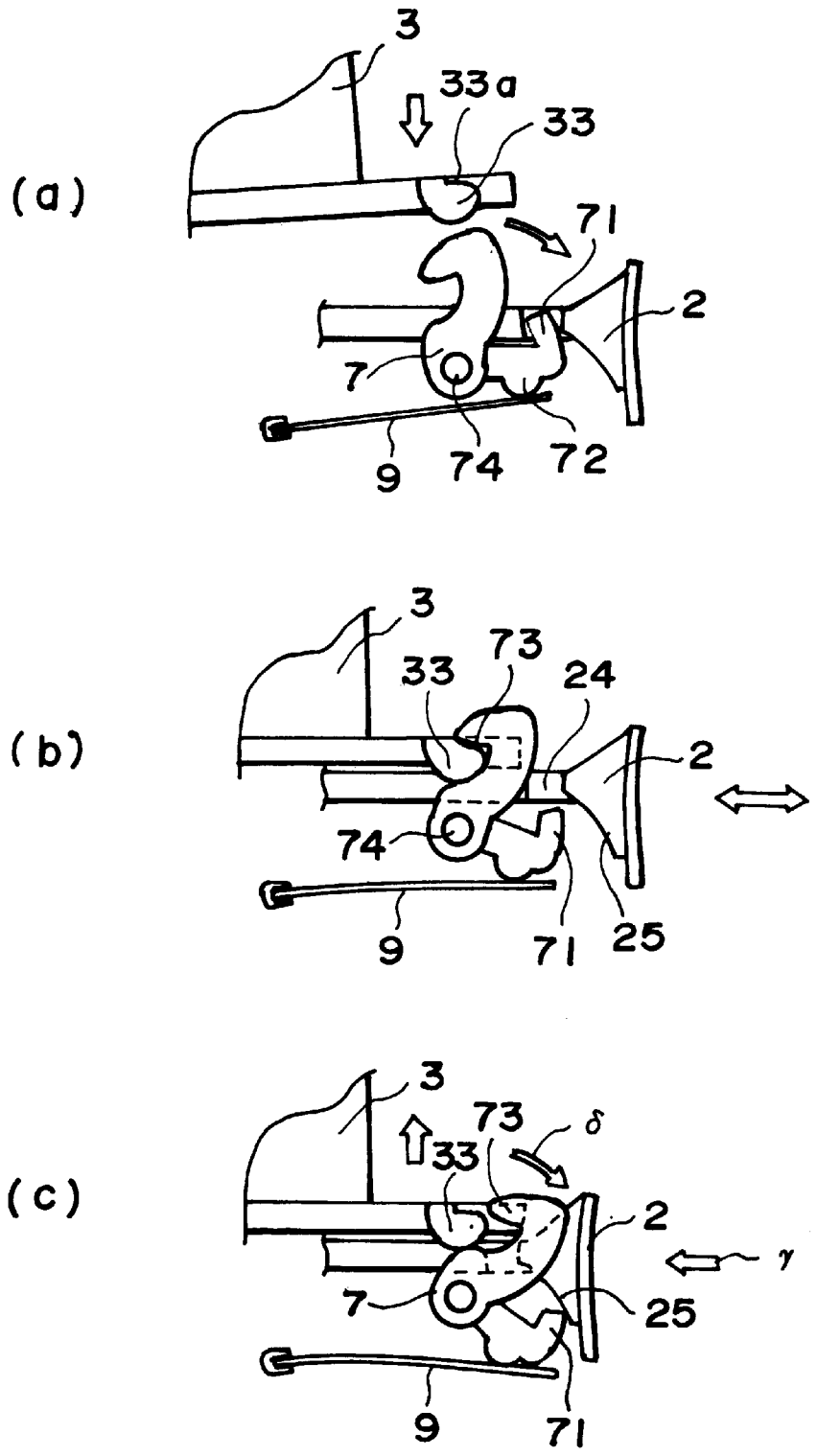
FIGS. 17(*a*), 17(*b*) and 17(*c*) are side views of a device which locks the developer supply container to the developer receiving container.
Figure 18:
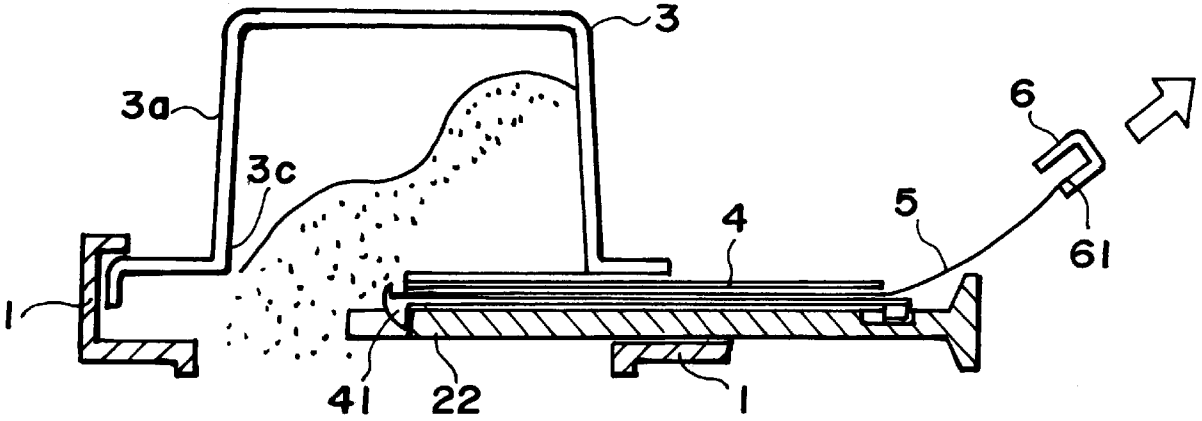
FIG. 18 is a longitudinal sectional view illustrating a developer supplying function.
Figure 20:
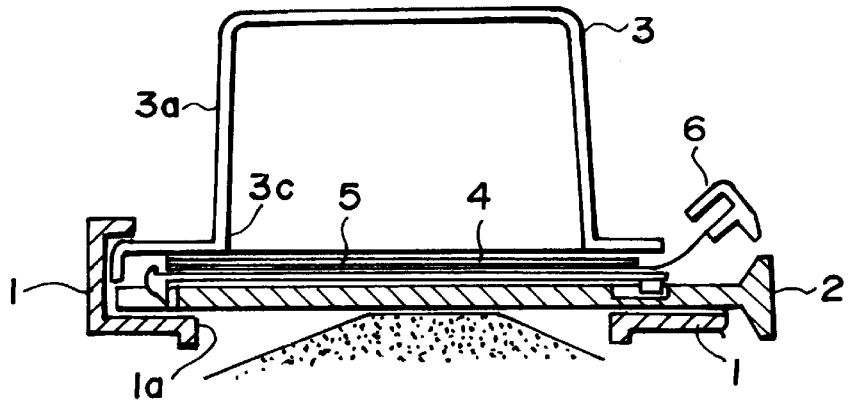
FIG. 20 is a longitudinal sectional view illustrating a covering member closing operation after developer supply.
Figure 21:
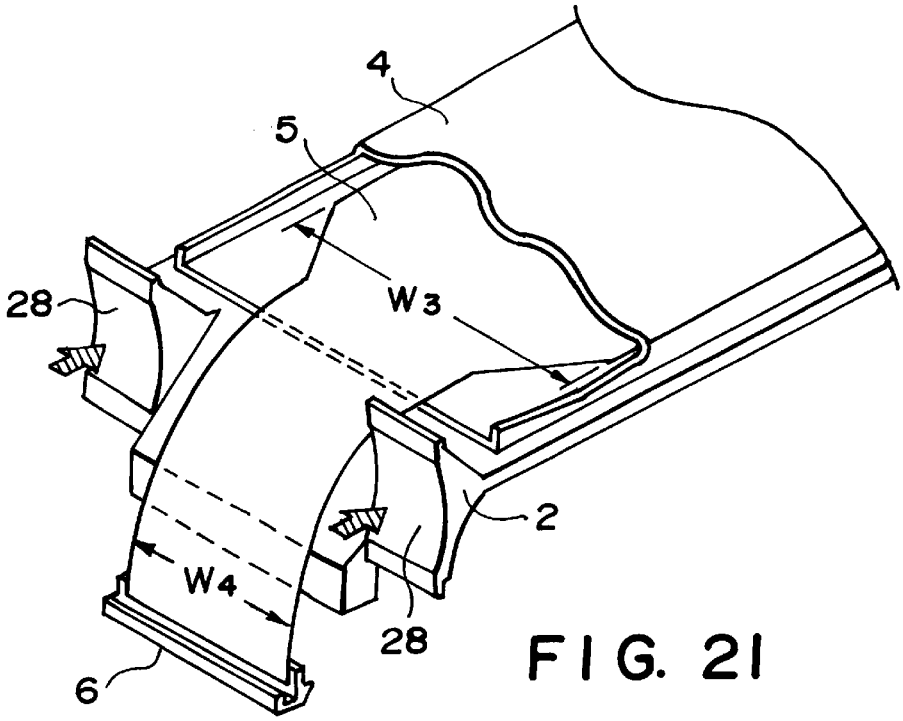
FIG. 21 is a perspective view illustrating a relation between the covering member of the developer receiving container and the sheet width.
Figure 22:
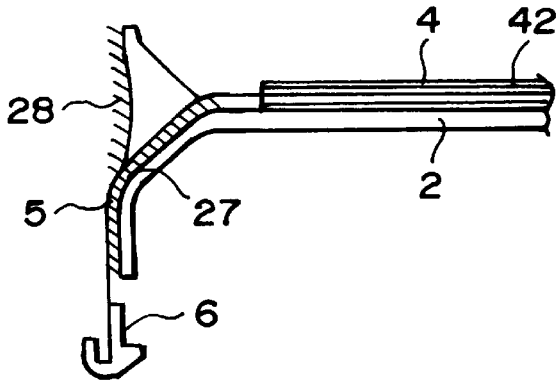
FIG. 22 is a longitudinal sectional view illustrating a relation between the covering member of the developer receiving container and the sheet free end.

The description will be made as to the embodiments of the present invention in conjunction with the accompanying drawings. FIG. 1 is a perspective view of a developer supply container, wherein a part is cut. FIG. 2 is a top plan view of the container of FIG. 1. FIG. 3 is a side view of the container of FIG. 1. FIG. 4 is a front view of the container of FIG. 1. FIG. 5 is a perspective view of an outer appearance of a developer supply container. FIG. 6 is a bottom view of a part of the container of FIG. 1. FIG. 7 is a partly enlarged sectional view as seen in a lateral direction in FIG. 3. FIG. 8 is an exploded perspective view showing a device locking a free end portion or leading end portion of the toner seal. FIG. 9 is a perspective view of a developer receiving container mounted in a main assembly of an image forming apparatus. FIGS. 10 and 11 are perspective views illustrating mounting of the developer supply container to the developer receiving container. FIG. 12 is a longitudinal sectional view illustrating mounting of the developer supply container to the developer receiving container. FIG. 13 is a longitudinal sectional view taken along a line perpendicular to the line along which FIG. 12 is taken. FIG. 14 to FIG. 16 and FIG. 18 to FIG. 20 are longitudinal sectional views illustrating unsealing function of the unsealing operation. FIGS. 17(*a*) 17(*b*) and 17(*c*) are side views illustrating a structure for locking the developer supply container to the developer receiving container. FIG. 21 is a perspective view illustrating a width of the toner seal. FIG. 22 is a longitudinal sectional view of the container of FIG. 21.

As shown in FIGS. 12 and 13, the developer supply container 3 is generally cubic having an opening 3*c* at its bottom side, and includes a flange 3*f* around the opening 3*c*. The flange 3*f* has a sliding surface 32 as shown in FIG. 13, and a shutter or covering member 4 is movably engaged along the sliding surface 32. A flexible sheet 5 is peelably welded, and is pasted on a sheet pulling member 6 (member to be pulled out) as will be described hereinafter. The sheet pulling member 6 is a grip of synthetic resin material in this example. The grip is a force applying portion on which the operator applies pulling force by hand to unseal the opening 3*c*.

As shown in FIG. 5, the seal pulling member 6 and the part therearound is covered by a cover portion 3*p* having a channel-like cross-section in a direction perpendicular to the direction of the sheet pulling. A space 3*q* is provided between itself and the flange 3*ff* (front side).

The channel-like cover portion 3*p* is integral with a main body 3*a* of the developer supply container 3, the flange 3*ff* and the cylinder 3*j* or the like, and the space 3*q* accommodates a sheet pulling member 6 and a pusher 8 as in FIG. 1. Before the operator mounts the developer supply container to the operator, the channel-like cover portion 3*p* prevents inadvertent touching to the pop-up device and the sheet end in the space 3*q*.

As shown in FIGS. 2 and 3, 3, in a rear part end wall 3*al* of the container body 3*a*, there is formed a cylindrical developer supply opening 3*r*, into which a developer covering member 13 is removably press-fitted.

The developer is supplied through the developer supply opening 3*r* into the container body 3*a* with the opening 3*c* thereof sealed by the sheet 5, and a developer covering member 13 is press-fitted into the developer supply opening 3*r*.

FIGS. 9, 12, and 13 show a developer receiving container 1 provided in a main assembly of the image forming apparatus. The developer is fed from the container 1 by screw or the like to a developing device having a developing roller for forming a developed image by supplying the developer to the electrostatic image bearing member. The opening 1*f* of the container 1 is covered by a covering member 2 of a slide type, which is slidable rightwardly in FIG. 12. Behind the developer receiving container 1, there is formed a recess 14 into which a projected portion 3*b* provided on a rear part of the flange 3*f* of the developer supply container is inserted, and a guide 1*a* guiding the insertion.

The container body 3*a* of the developer supply container 3 of this embodiment accommodates a proper amount of the developer for supply, and the opening 3*c* is covered by a covering member 4 of a slide type, which is slidable rightwardly in FIG. 12. The covering member 4 of the developer supply container 3 is provided at an end with a projection 41 for engagement with an end 22 in the direction of an inward slide of the covering member 2 of the developer receiving container 1, and the covering member 4 of the developer supply container is provided with a shallow hollow portion 42 having an opening at the opposite ends in the direction of the slide. A lower side of the front part of the covering member 4 of the developer supply container 3 is provided with a projection 43 engageable with a recess 21 formed in an upper front side of the developer receiving container 1.

The flange 3*f* is extended all around the lower surface opening 3*c* of the container body 3*a*. To the flange 3*f*, a flexible sheet in the form of a film-like 5 is removably secured by welding or the like with a sticking strength enough to prevent the leakage of the developer. The total length of the sheet 5 is longer than twice as long as the one side of the opening 3*c* of the container body 3*a*, measured in the direction of unpeeling of the sheet 5. The remaining part of the sheet 5 which is not secured to the flange 3*f* of the container of the container body 3*a* is folded back at a portion 5*a* adjacent the projected portion 3*b*, and then is extended in the space 42 in the covering member 4 of the developer supply container and is secured to the sheet pulling member 6 with sufficient strength to prevent easy removal, as shown in the Figures. The sheet pulling member 6 is of synthetic resin material, in this embodiment, but it may be provided by forming the end of the sheet 5 into the similar shape.

The length of the sheet 5 from the inner space 42 of the covering member 4 of the developer supply container to the portion secured to the sheet pulling member 6, is such that when the sheet pulling member 6 is popped out from the container body 3*a* as will be described hereinafter, the operator can grip it and pull it. When the sheet pulling member 6 is locked in the container body 3*a*, the rest portion of the sheet 5, as shown in FIG. 7, is folded between the covering member 4 of the developer supply container and the sheet pulling member 6 so as not to be out of the developer supply container 3.

The dimensions of the openings of the developer supply container 3 and the developer receiving container 1, as shown in FIGS. 12 and 13, are such that length $K_1$ in the pulling direction of the covering members 2, 4 is larger than $K_2$ and that width $W_1$ measured in the direction perpendicular to the opening direction is larger than $W_2$. By this, opening 1*a* of the developer receiving container 1 is larger than the opening 3*c* of the developer supply container 3 so that guiding rails for the covering members 4, 2 of the container body 3*a* and the developer receiving container 1 are prevented from being contaminated scattering developer.

The flange surface 31 of the flange 3*f* to which the sheet 5 of the container body 3*a* is attached is provided with a step to avoid heavy pressure to the sheet to make smooth the movement of the sheet 5 relative to the sliding surface 32 of the covering member 4 of the developer container. In left and right sides (3*ff*) of the front part flange 3*f* at the opposite side from the rear side having the projected portion 3*b*, as shown in FIGS. 1, 2 and 6, two slits 3*g* extending in the sheet pulling direction are formed at each side, and the portion between the slits 3*g* is movable and constitutes a hook 3*h* functioning as a projection (locking portion) at the end thereof as shown in FIGS. 6 and 7. The locking portion is not limitedly a projection, and may be a recess or other, if engagement is accomplished.

The hook 3*h* blocks the projection 6*a* (portion to be engaged) projected outwardly at the left and right sides of the sheet pulling member 6, thus preventing outward motion of the sheet pulling member 6. Therefore, the hook 3*h* has a function as a locking member for locking the sheet pulling member 6 before the developer supply container is mounted to the image forming apparatus. The width of the movable portion 3*i* is large enough so that movable portion 3*i* is outside the contact portion between the projection 6*a* and the hook 3*h*.

The portion to be engaged is not limited to the projection, and may be a recess or a hole.

As shown in FIGS. 6 and 7, the sheet pulling member is provided with a sheet sticking plate portion 6*b* on which the end of the flexible sheet 5 is attached, and a force receiving portion 6*c* for receiving the force in the popping out direction of sheet pulling member 6. They are provided at each of left and right sides. As shown in FIG. 7, a recess(groove) 6*d* (as seen from a lateral side) as shown in FIG. 7 is provided between the sheet sticking plate portion 6*b* and the force receiving portion 6*c*. As shown in FIG. 8, the projection 6*a* (left and right) of the sheet sticking portion 6*b* and the sheet sticking plate portion 6*b* are parts of the same plate member.

In the assembled state, a middle of the front part flange 3*ff* (left and right) is placed in the recess 6*d* of the sheet pulling member 6.

A pusher member 8 is provided to push an end of the force receiving portion 6*c* is substantially yoke-shaped, as shown in FIG. 8, and at the left and right sides thereof, there are provided pressing portions 8*a* for pressing the force receiving portions 6*c* of the sheet pulling member 6. A parallel york rod 8*b* penetrates the container body 3*a* and a cylinder 3*j* integral with the flange 35 or fixed to the container body 3*a*, and has an end stopper 8*c* projected outwardly in the radial direction beyond the outer diameter of the york rod 8*b*. The york rod 8*b* has a flange 8*d* movably engaged with the cylinder 3*j*, and between the end wall 3*k* at the rear side of the cylinder 3*j* and the flange 8*d*, a compression coil spring 10 is compressed and supported around the york rod 8*b*. The yoke rod 8*b* is movably engaged with the hole in end wall 3*k*.

As shown in FIG. 6, the movable portion 3*i* of front part flange 3*ff* has a release contact portion 3*m* adjacent the hook 3*h*. When the release contact portion 3*m* is pushed in the direction of an arrow $\alpha$, the end of the movable portion 3*i* deforms upwardly to move the hook 3*h*. The pusher member 8 (york) urged in the sheet pulling direction by the spring force of the compression coil spring 10 is released from engagement with the hook 3*h* through the force receiving portion 6*c* of the sheet pulling member 6, so that it pops out in the sheet pulling direction, and therefore, the sheet pulling member 6 pops out in the sheet pulling direction. The flexible sheet 5 continuing to the sheet pulling member 6 is accommodated in the space between the front part flange 3*ff* and the lower plate 4*a* (FIG. 12) extended in the pulling direction from the covering member 4 of the developer supply container 3, so that it is also popped out.

As shown in FIG. 9, a releasing projection 2*a* is extended upwardly at a front side in the pulling direction of the covering member 2 mounted to the developer receiving container 1. When the developer supply container 3 is mounted to the developer receiving container 1, the projection 2*a* abuts the release contact portion 3*m* adjacent the hook 3*h* as the locking portion of the developer supply container 3, and when the developer supply container 3 is inserted, the hook 3*h* is moved to be disengaged from the projection 6*a* provided in the sheet sticking portion 6*b*.

As shown in FIG. 13, the developer receiving container 1 is provided with a plunger 11 having a flange vertically movable at the walls outside the guiding rail 30 for the covering member 2 of the developer receiving container 1 to facilitate the removal by automatically raising the developer supply container 3 when the covering member 2 of the receiving container is closed. The plunger 11 is urged by the compression coil spring 12. The upper end of the plunger 11 is such that projection 3*n* (FIGS. 1, 2) provided on the flange 3*f* (left and right) at the cut-away portion of the developer receiving container 1, pushes the plunger 11 against the spring force of the compression coil spring 12.

As shown in FIG. 1, from the bottom front end of the container body 3*a*, a projection 33 is extended downwardly. The projection 33 is provided with an engaging recess 33*a*. The front corner of the projection 33 is rounded. As shown in FIG. 9, the developer receiving container 1 is provided with a shoot 1*c* which inclines down toward the rear side. The free end of the projection 33 is in sliding contact with the shoot when the developer supply container 3 is mounted to the developer receiving container 1. A tunnel 1*e* is formed by a bridge 1*d* adjacent the shoot 1*c*. The tunnel 1*e* permits the sheet pulling member 6 to pass substantially horizontally.

The description will be made as to the mounting of developer supply container 3 to the developer receiving container 1 and the supplying operation of the developer.

The image forming apparatus is placed on a floor so that upper portion of the developer receiving container 1 is horizontal.

Figure 14:
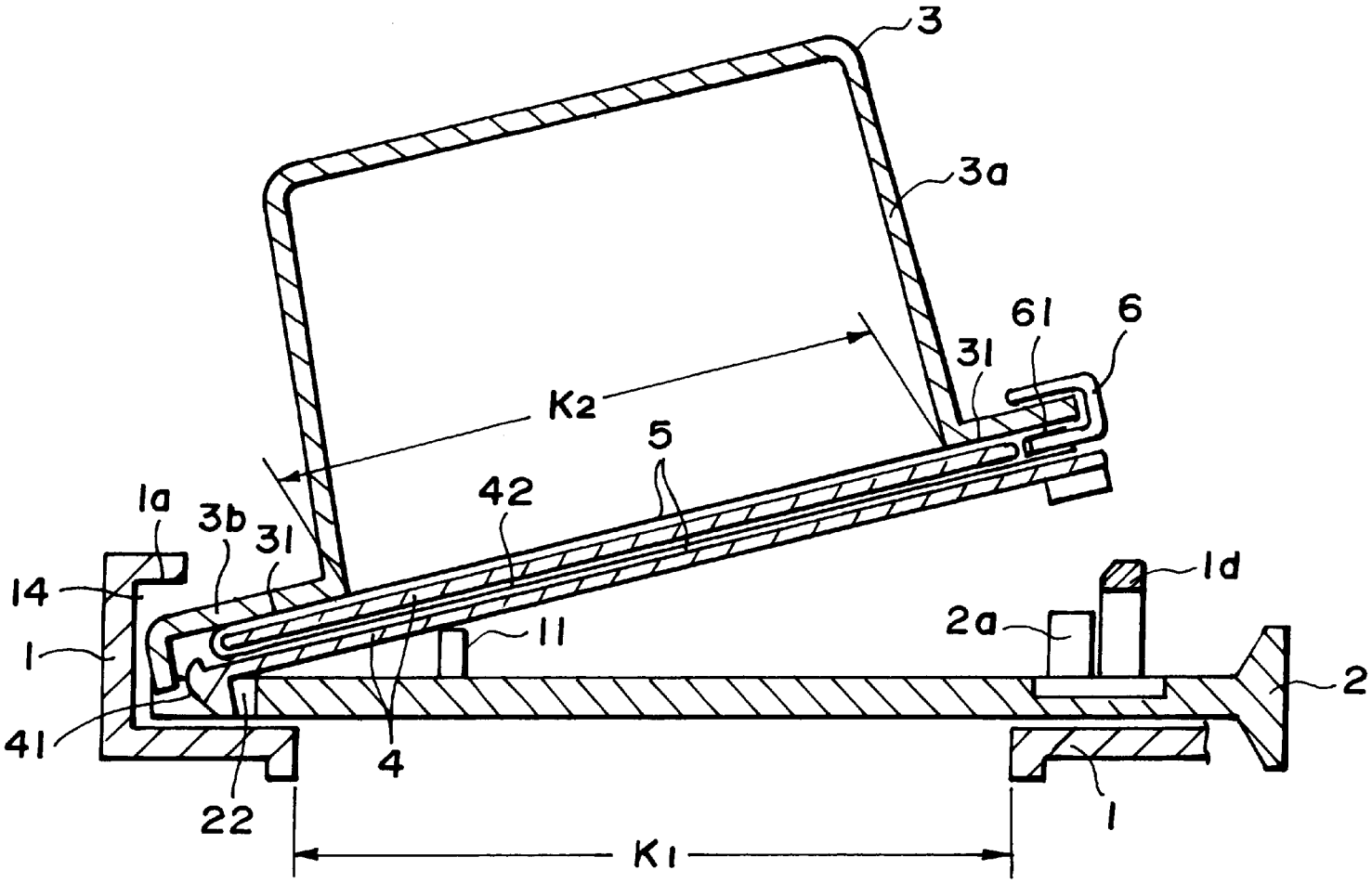
FIG. 14 is a longitudinal sectional view illustrating mounting of the developer supply container to the developer receiving container.

As shown in FIG. 14, the rear part of the developer supply container 3 is placed on the receiving container 1, while inserting the rear projected portion 3*b* with the developer supply container 3 being inclined (front side up) toward the rear recess 14 of the developer receiving container 1. The projection portion 3*b* of the developer supply container 3 is limited by the guide 1*a* in the recess 14 against the upward movement.

Figure 15:
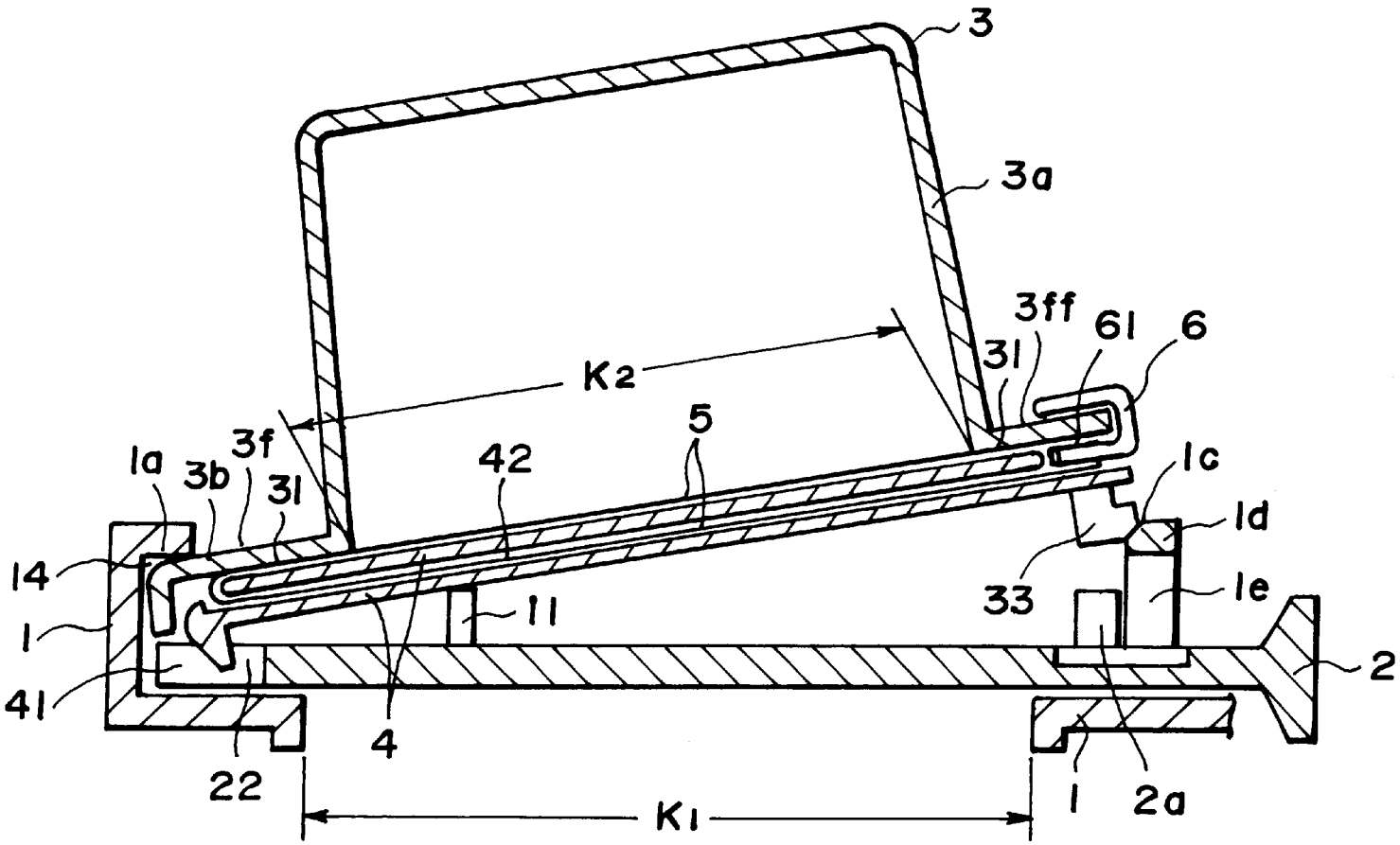
FIG. 15 is a longitudinal sectional view illustrating mounting of the developer supply container to the developer receiving container.

As shown in FIG. 15, the front side of the developer supply container 3 is rotated down with the projected portion 3*b* being inserted in the recess 14, the projections 3*n* provided on the flange 3*f* at the left and right sides of the developer supply container 3 abut the plunger 11 of the developer receiving container 1. With this state, the developer supply container 3 is maintained in the inclined state by the plunger 11 supporting the projection 3*n* with the projected portion 3*b* being in the recess 14 of the developer receiving container 1.

As shown in FIG. 15, the front side of the developer supply container 3 is pushed against the downward spring force of the compression coil spring 12 which raises the plunger 11, by which the front side of the developer supply container 3 lowers by rotation about the engaging portion between the recess 14 of the developer receiving container 1 and the projected portion 3*b* of the developer supply container 3. Then the projection 33 extended from the developer supply container 3 abuts the shoot of the developer receiving container 1. When the developer supply container 3 is pushed down, the projection 33 slides on the shoot 1*c* to push the developer supply container 3 rearwardly, by which the projected portion 3*b* of the developer supply container 3 is pushed into the rear side of the developer receiving container 4, so that developer supply container 3 is generally positioned relative to the developer receiving container 1 (FIG. 16).

By the projection 33 of the developer supply container 3 moves down along the shoot 1*c*, the release contact portion 3*m* of the movable portion 3*i* at the front side of the developer supply container 3 is abutted to the projection 2*a* provided in the covering member 2 of the developer receiving container 1.

When the developer supply container 3 is lowered, the release contact portion 3*m* is blocked by the projection 2*a* of the covering member 2, so that base portion of the movable portion 3*i* on which the release contact portion 3*m* is provided is lowered, and therefore, the sheet sticking plate portion 6*b* is moved down, too. The projection 6*a* of the sheet pulling member 6 connected to the sheet sticking member is disengaged from the hook 3*h*, and the sheet pulling member 6 is popped out by the advancement of the pusher member 8 urged by the compression coil spring 10, as shown in FIG. 16. The portion of the flexible sheet 5 folded in the space between the sheet pulling member 6 and the covering member 4 at the front side, is also popped out. At this time, the moving direction of the sheet pulling member 6 is regulated to be horizontal by the tunnel 1*e* of the developer receiving container 1.

When the operator supplies the toner, the operator does not wonder what should be pulled, and can understand immediately that sheet pulling member 6 popped out of the cover portion 3*p* should be pulled out. The sheet pulling member 6 is easily gripped since it is now outside.

In the mounting operation of the developer supply container 3 to the developer receiving container 1, when the side of the developer supply container 3 where the sheet pulling member 6 is engaged (front side) is lowered with the projected portion 3*b* of the developer supply container 3 being in the recess 14 of the developer receiving container 1, the developer supply container 3 is locked in the developer receiving container 1 in the manner described below. As shown in FIG. 17(*a*), when the developer supply container 3 is not mounted to the toner receiving container of the image forming apparatus, the locking member 7 provided in the receiving container 1 and urged in the counterclockwise direction in the FIG. by the elastic member(leaf spring) 9, is engaged with the slit 24 of the covering member 2 by the claw portion 71 to prevent the opening and closing sliding action of the covering member 2. When the developer supply container 3 is mounted, the locking member 7 pushed by the projection 33 of the developer supply container 3, rotates in the direction indicated by the arrow in the Figure (clockwise direction) about the center of rotation 74 against the elastic member 9 so that projection 33 and the hook member 73 are engaged with each other. As shown in FIG. 17(*b*), the developer supply container 3 is locked to prevent dismounting. When the locking member 7 is rotated in the clockwise direction, the claw portion 71 simultaneously rotates, and as shown in FIG. 17(*c*), in the locked state of the developer supply container 3, the engagement between the claw portion 71 and the slit 24 of the covering member 2 is released to permit the sliding motion of the covering member 2.

When the sheet pulling member 6 (grip portion) is pulled in the pulling direction, the portion of the sheet 5 which is secured to the flange 3*f* around the opening 3*c* of the container body 3*a* is peeled gradually off the flange from the folded back side, and the folded back position 5*a* moves in the sheet pulling direction, and the folded back portion pushes the covering member 4 of the developer supply container 3 to the opening direction. Simultaneously, the leading edge 22 (in the inward sliding direction) of the covering member 2 of the developer receiving container 1 is pushed by the projection 41 at the rear portion of the covering member 4 of the developer supply container 3, so that covering member 2 of the developer receiving container 1 is moved in the opening direction together with the covering member 4 of the developer supply container 3. By this, the opening 3*c* of the developer supply container 3 opened more to let the developer fall into the container 1 developer receiving from the developer supply container 3.

Figure 19:
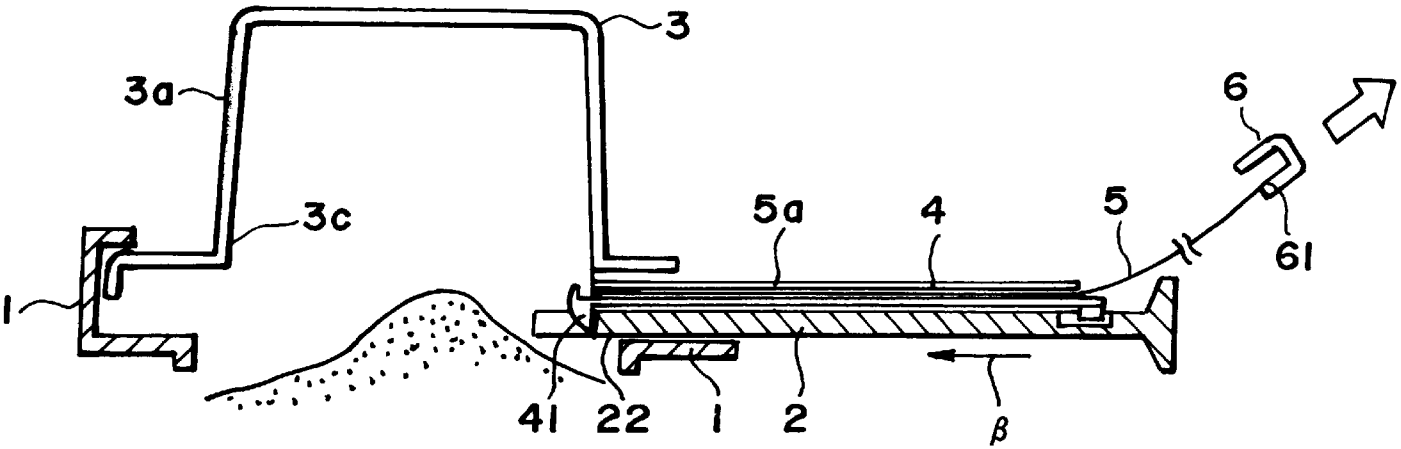
FIG. 19 is a longitudinal sectional view illustrating a developer supply function.

As shown in FIG. 19, when the opening 3*c* of the developer supply container 3 is fully opened, and all the developer falls into the developer receiving container 1 (that is, the sheet 5 is completely pulled out), the portion of the sheet 5 on which the developer is deposited, is still in the hollow portion 42 of the covering member 4 of the developer supply container 3. Therefore, the operator is not liable to contact the developer remaining on the sheet 5. Therefore, there is no need of using a cleaning pad for scraping the developer from the sheet 5, and the developer supply apparatus is downsized, and the cost thereof is lowered.

After the developer is supplied in this manner, the covering member 2 of the developer receiving container 1 is closed in the direction β in FIG. 19, the end 22 of the covering member 2 of the developer receiving container 1 is brought into engagement with the projection 41 of the covering member 4 of the developer supply container 3, so that covering member 4 of the developer supply container 3 is closed, and the covering member 4 of the developer supply container 3 is closed while pulling the sheet 5 and the sheet pulling member 6 back into inside.

The developer in the developer supply container 3 may be in the state as shown in FIG. 19. Even if this occurs, the developer does not enter the gap between the covering members 2, 4, since the ends (in the closing direction) of the covering member 2 of the developer receiving container 1 and the covering member 4 of the developer supply container 3 are engaged, and therefore, the peak of the developer is destroyed into uniform state, as shown in FIG. 20 by the covering members 2, 4. As shown in FIG. 21, the width of the sheet 5 is $W_3$ which is larger than width $W_2$ (FIG. 13) of the opening in the region where it is secured to the edge of the opening 3*c* of the developer supply container 3, but is $W_4$ which is smaller than $W_3$ in the region where it is pulled out of the covering member 4. The width $W_4$ permits passing between two grip portions 28 provided spaced apart in the direction perpendicular to the slide direction at the end of the covering member 2 of the developer receiving container 1, and when the covering member 2 of the developer receiving container 1 is closed, the sheet 5 passes between the grip portions 28 of the covering member 2 of the developer receiving container 1 and is pulled into the space 42 of the covering member 4 of the developer supply container 3. When the covering member 2 of the developer receiving container 1, the opening 3*c* of the developer supply container 3 is closed by the covering member 4 as shown in FIG. 20, and the opening 1*a* of the developer receiving container 1 is closed by the covering member 2.

As shown in FIG. 22, the grip portion 28 is stepped relative to the surface 27 on which the sheet 5 passes, so that operator is prevented from inadvertently pushing the covering member 2 through the sheet 5 when the covering member 2 is closed. Thus, the width of the sheet 5 is smaller than the width of the portion covering the opening 3*c* other than where the opening 3*c* of the developer supply container 3 is covered, and therefore, the sheet 5 peeled off during the developer supply, passes along the low surface 27 (lower than the grip portion 28 of the covering member 2) of the stepped portion when the covering member 2 of the developer receiving container 1 is closed, so that operativity of the developer supply is improved.

When the opening 1*a* of the developer receiving container 1 is closed by the covering member 2, and the opening 3*c* of the developer supply container 3 is completely closed by the covering member 4, then the sheet pulling member 6 is slightly extended out of the container body 3*a*.

As shown in FIG. 17(*c*), when the covering member 2 of the developer receiving container 1 is pushed in the direction indicated by the arrow, a cam surface 25 of the covering member 2 pushes a claw portion 71 of the locking member 7 slightly before the covering member 2 is completely closed, and the locking member 7 rotates in the direction δ against the elastic member 9 (clockwise in the Figure). By this, the claw portion 73 and the projection 33 of the developer supply container 3 are disengaged from each other, the plunger 11 urging the developer supply container 3 upwardly by the spring force of the compression coil spring 12 raises the developer supply container 3 by rotation about the projection 3*b* inserted into the recess 14 of the developer receiving container 1. The developer supply container 3 is removed from the developer receiving container 1 while removing the projected portion 3*b* from the recess 14.

When the operator stops the covering member 2 pushing action, the covering member 2 resumes the sliding motion in the cover opening direction by pushing action, to the cam surface 25, of the claw portion 71 of the locking member 7 urged in the counterclockwise direction elastically by the elastic member 9, and immediately thereafter, the claw portion 71 is engaged into the hole 24 of the covering member 2 by the urging force of the elastic member 9, so that motion of the covering member 2 of the developer receiving container 1 stops and is locked.

In the state before the use of the developer supply container 3, as shown in FIG. 6, the hook 3*h* is disposed adjacent the projection 33 at a rear side of the cut 4*e* (width approx. 5 mm) at the pulling side corner of the opening covering member 4 of the developer supply container 3, so that hook 3*h* is not inadvertently pushed.

In the embodiment, the opening 3*c* of the developer supply container 3 is sealed by the sheet 5, and the covering member 4 is provided, but the present invention can be implemented without the covering member 4. Additionally, the opening 3*c* may be sealed only by the covering member 4. In such a case, as shown in FIG. 23(*d*), a projection 6*a* may be provided at the pulling side end of the covering member 4, and the sheet pulling member 6 may be integrally formed with the covering member 4, or as shown in FIG. 23(*a*), the covering member 4 and the sheet pulling member 6 may be separate members, and the covering member 4 and the sheet pulling member 6 may be connected by a short flexible member 6*e*.

By doing so, the pusher 8 urged by the spring force of the compression coil spring 10 directly pushes the covering member 4 out, or pushes the sheet pulling member 6 out to expand the flexible member 6*e* connecting the covering member 2 and the sheet pulling member 6. By this, the portion pulled by the operator is popped out, and therefore, the operativity is improved.

The sheet pulling member 6 as the member to be popped out, is not limited to be a rigid member (resin material for example), but may be any if it can be popped out. For example, as shown in FIG. 23(*c*), of FIG. 23, the structure may be such that after the pulling member is pushed out, the operator grips a part of the flexible sheet to unseal the developer supply container.

Figure 23:
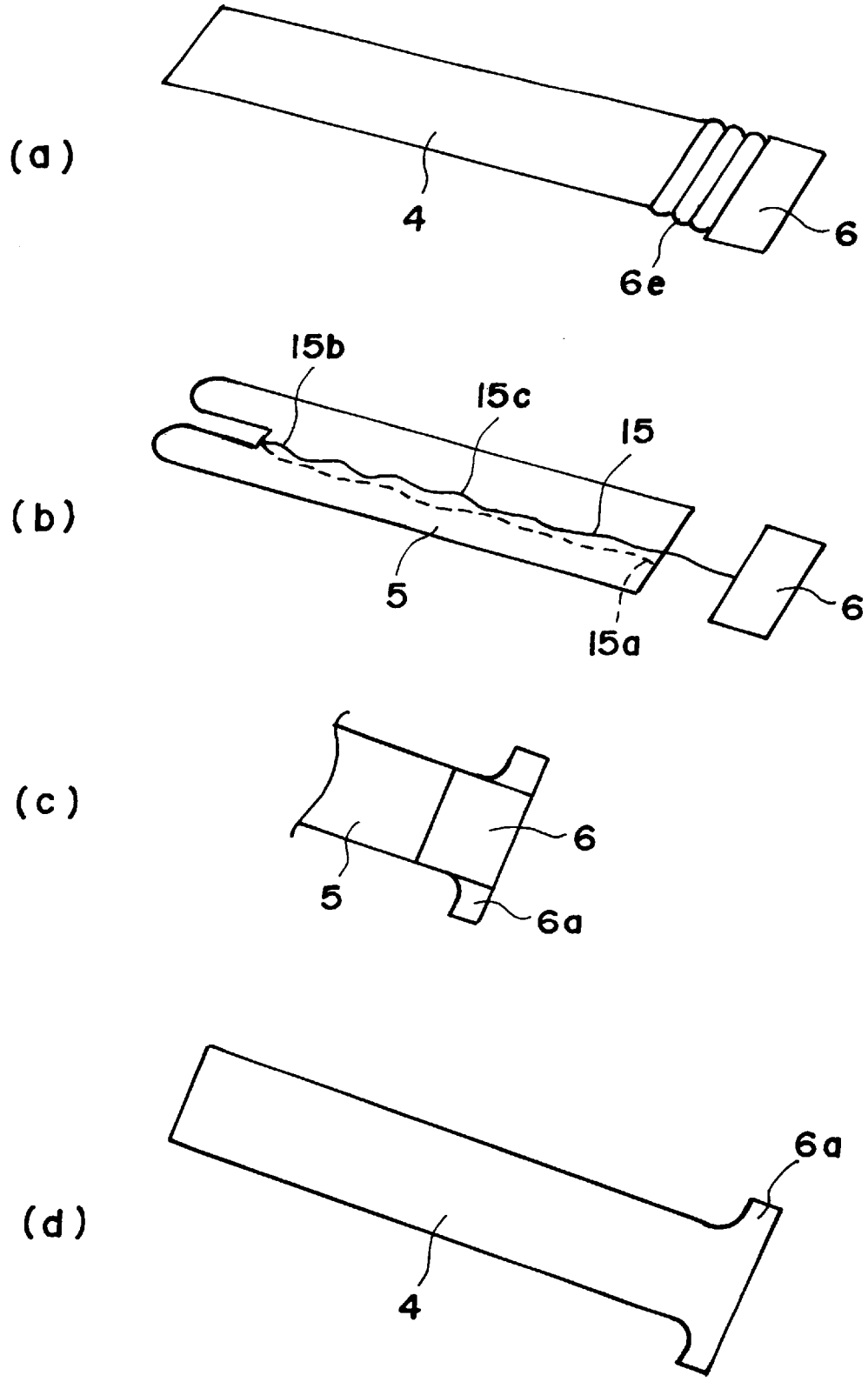
FIG. 23 is a perspective view of a member which seals an opening of the developer receiving container.

FIG. 23(*b*) shows an example in which the covering member 4 is not used, but a string 5 is strongly bonded on the back side of the sheet 5 (the side faced to the toner) on the sheet 5 stuck on the periphery of the opening 3*c* from one end 15*a* to the folded back portion 15*b*, and from the folded back portion 15*b*, it is extended in a free state, and the end thereof is fixed to a pulling member 6. By pulling the pulling member 6, the sheet 5 is torn from the folded back portion toward the one end 15*a*.

While the invention has been described with reference to the structures disclosed herein, it is not confined to the details set forth and this application is intended to cover such modifications or changes as may come within the purposes of the improvements or the scope of the following claims.

What is claimed is:

1. A toner supplying container detachably mountable to an image forming apparatus, comprising:

a container body for accommodating toner, said container body being provided with an opening for permitting a supply of the toner into a toner receiving container;

a removable sealing member for sealing said opening, said sealing member is provided with a force applying portion for applying a force for removing said sealing member from said opening;

an elastic member urging said force applying portion from a predetermined position in a direction of removing said sealing member and;

a releasable locking member for releasably locking said force applying portion of said sealing member at the predetermined position against elastic force of said elastic member.

2. A toner supplying container according to claim 1, wherein said locking member is released in interrelation with a mounting action of said toner supplying container to the image forming apparatus, and said force applying portion is moved in the direction of removing said sealing member from the predetermined position by the force of said elastic member.

3. A toner supplying container according to claim 1, wherein said force applying portion comprises a grip, which is moved in the direction of removing said sealing member when said locking member is released.

4. A toner supplying container according to claim 3, wherein said locking member is contactable to said grip to lock said grip at the predetermined position.

5. A toner supplying container according to claim 4, wherein said locking member comprises a projection extended from said container body, and the projection is contacted to said grip when said grip is locked at the predetermined position, and is disengaged therefrom when said grip is released from the predetermined position.

6. A toner supplying container according to claim 1, further comprising a covering member for covering said opening, wherein said covering member opens said opening in interrelation with removal of said sealing member.

7. A toner supplying container according to claim 1, wherein said sealing member comprises a film.

8. A toner supplying container according to claim 1, wherein said elastic member comprises a spring.

9. A toner supplying container according to claim 1, wherein said sealing member comprises an extension beyond a portion covering said opening, and said extension is provided with a folded portion where said sealing member is folded back toward an opening direction.

10. A toner supplying container according to claim 1, wherein an end of said extension is maintained in a folded condition when said locking member locks said force applying portion.

11. A toner supplying container according to claim 1, wherein said toner receiving container comprises an opening for receiving the toner supplied from said toner supplying container and a covering member for covering said opening, wherein said covering member of said toner supplying container comprises an engaging portion for engagement with the covering member of said toner receiving container to open the covering member of said toner receiving container in interrelation with the opening of said covering member of said toner supplying container after said toner supplying container is mounted to the image forming apparatus.

12. A toner supplying container according to any one of claims 1 to 11, wherein said toner receiving container is provided in said image forming apparatus.

13. A toner supplying container detachably mountable to an image forming apparatus, comprising:

container body for accommodating toner, said container body being provided with an opening for permitting supply of the toner to a toner receiving container;

a removable sealing member for sealing said opening;

a grip for applying force for removing said sealing member from said opening;

a cover portion for covering said grip before said toner supplying container is mounted to the image forming apparatus; and popping means for popping said grip out of said cover portion to expose said grip in interrelation with mounting of said toner supplying container to the image forming apparatus.

14. A toner supplying container according to claim 13, wherein said popping means includes an elastic member for urging said grip with an elastic force from a first position in which said grip is covered with said cover portion toward a second position in which said grip is exposed from said cover portion, said toner supplying container further comprising a locking member for releasably locking said grip at a position where said grip is covered by said cover portion.

15. A toner supplying container according to claim 14, wherein said locking member is released in interrelation with mounting of said toner supplying container to the image forming apparatus, and said grip is moved from said first position to said second position by the elastic force of said elastic member.

16. A toner supplying container according to claim 14, wherein said locking member is contactable to said grip to lock said grip at said first position.

17. A toner supplying container according to claim 16, wherein said locking member comprises a projection extended from said container body, and the projection is contacted to said grip when said grip is locked at the predetermined position, and is disengaged therefrom when said grip is released from the predetermined position.

18. A toner supplying container according to claim 13, further comprising a covering member for covering said opening, wherein said covering member opens said opening in interrelation with removal of said sealing member.

19. A toner supplying container according to claim 13, wherein said sealing member comprises a film.

20. A toner supplying container according to claim 14, wherein said elastic member comprises a spring.

21. A toner supplying container according to claim 13, wherein said sealing member comprises an extension beyond a portion covering said opening, and said extension comprises a folded portion where said sealing member is folded back toward a popping direction of said popping means.

22. A toner supplying container according to claim 21, wherein an end of said extension is maintained in a folded condition when said grip is covered by said cover portion.

23. A toner supplying container according to claim 13, wherein said toner receiving container comprises an opening for receiving the toner supplied from said toner supplying container and a covering member for covering said opening, wherein said covering member of said toner supplying container comprises an engaging portion for engagement with the covering member of said toner receiving container to open said covering member of said toner receiving container in interrelation with said opening of said covering member of said toner supplying container after said toner supplying container is mounted to the image forming apparatus.

24. A toner supplying container according to claim 13, wherein the direction of popping of said grip by said popping means is substantially the same as a direction in which said grip is pulled to remove said sealing member from said opening.

25. A toner supplying container according to any one of claims 13 to 24, wherein said toner receiving container is provided in the image forming apparatus.

26. A toner receiving container for receiving toner from a toner supplying container, comprising:

a mounting portion for mounting a toner supplying container, which includes:

a container body for accommodating toner, said container body being provided with an opening for permitting supply of the toner into a toner receiving container;

a removable sealing member for sealing said opening, said sealing member being provided with a force applying portion for applying force for removing said sealing member from said opening;

an elastic member for applying an elastic force urging said force applying portion from a predetermined position in a direction of removing said sealing member;

a releasable locking member for releasably locking said force applying portion of said sealing member at the predetermined position against the force of said elastic member; and a releasing member for releasing said locking member from said predetermined position when said toner supplying container is mounted to said mounting portion.

27. A toner receiving container according to claim 26, further comprising a toner receiving opening for receiving the toner from said toner supplying container, and a cover member for covering said opening, and wherein said releasing member is provided in said cover member of said toner receiving container.

28. A toner receiving container according to claim 27, wherein said toner supplying container comprises a covering member for covering said opening of said toner supplying container, wherein said covering member of said toner receiving container comprises an engaging portion for engagement with the covering member of said toner supplying container to open said covering member of said toner receiving container in interrelation with said opening of said covering member of said toner supplying container after said toner supplying container is mounted to said mounting portion.

29. A toner receiving container according to claim 26, wherein said toner receiving container comprises an opening for receiving the toner supplied from said toner supplying container, a covering member for covering said opening, and a locking member for locking said opening, wherein when said toner supplying container is mounted to said mounting portion, said cover member locking member is released.

30. A toner supplying container detachably mountable to an image forming apparatus, comprising:

a container body for accommodating toner, said container body being provided with an opening for permitting a supply of the toner into a toner receiving container;

a sealing member for sealing said opening;

a grip portion for applying a force to said sealing member to open said opening;

an elastic member urging said grip portion; and a releasable locking member for releasably locking said grip portion at a predetermined position of said container body against an elastic force of said elastic member.

31. A container according to claim 30, wherein said releasable locking member releases said grip portion by a releasing portion of the image forming apparatus when said toner supply container is mounted to the image forming apparatus.

32. A container according to claim 31, wherein said elastic member urges said grip portion from the predetermined position in a sealing member opening direction.

33. A container according to claim 30, further comprising a covering member for covering said opening, wherein when said grip portion is pulled, said sealing member and said covering member are moved so as to open said opening.

34. A container according to claim 30, wherein said sealing member comprises a film.

35. A container according to claim 30, wherein said elastic member comprises a spring.

36. A container according to claim 30, wherein said sealing member comprises an extension beyond a portion covering said opening, and said extension is provided with a folded portion where said sealing member is folded back toward an opening direction.

37. A container according to claim 30, wherein an end of said extension is maintained in a folded condition when said locking member locks said force applying portion.

38. A container according to any one of claims 30 through 37, wherein said toner receiving container comprises an opening for receiving the toner supplied from said toner supplying container and a covering member for covering said opening, wherein a covering member of said toner supplying container is provided with an engaging portion for engagement with said covering member of said toner receiving container to open said covering member of said toner receiving container in interrelation with said opening of said covering member of said toner supplying container after said toner supplying container is mounted to the image forming apparatus.

39. A toner receiving container for receiving toner from a toner supplying container, comprising:

a mounting portion for mounting said toner supplying container including:

a container body for accommodating toner, said container body being provided with an opening for permitting supply of the toner into a toner receiving container;

a sealing member for sealing said opening;

a grip portion for applying force to said sealing member to open said opening;

an elastic member urging said grip portion;

a releasable locking member for releasably locking said grip portion at a predetermined position of said container body against an elastic force of said elastic member; and a releasing member for releasing said locking member from said predetermined position when said toner, supplying container is mounted to said mounting portion.

40. A container according to claim 39, further comprising a toner receiving opening for receiving the toner from said toner supplying container, and a cover member for covering said opening, and wherein said releasing member is provided in said cover member of said toner receiving container.

41. A container according to claim 40, wherein said toner supplying container comprises a covering member for covering said opening of said toner supplying container, wherein said covering member of said toner receiving container comprises an engaging portion for engagement with said covering member of said toner supplying container to open said covering member of said toner receiving container in interrelation with said opening of said covering member of said toner supplying container after said toner supplying container is mounted to the image forming apparatus.

42. A container according to claim 39, wherein said toner receiving container comprises an opening for receiving the toner supplied from said toner supplying container, a covering member for covering said opening, and a locking member for locking said opening, wherein when said toner supplying container is mounted to said mounting portion, said cover member locking member is released.

43. A toner supplying container detachably mountable to an image forming apparatus, comprising:

a container body for accommodating toner, said container body being provided with an opening for permitting supply of the toner into a toner receiving container;

a sealing member for sealing said opening;

a grip portion for applying force to said sealing member to open said opening; and a releasable locking member for releasably locking said grip portion at a predetermined position of said container body, wherein said releasable locking member releases said grip portion by a releasing portion of the image forming apparatus when said toner supply container is mounted to the image forming apparatus.

44. A container according to claim 43, further comprising a covering member for covering said opening, wherein when said grip portion is pulled, said sealing member and said covering member are moved so as to open said opening.

45. A container according to claim 43, wherein said sealing member comprises a film.

46. A container according to claim 43, wherein said elastic member comprises a spring.

47. A container according to claim 43, wherein said sealing member comprises an extension beyond a portion covering said opening, and said extension comprises a folded portion where said sealing member is folded back toward an opening direction.

48. A container according to claim 43, wherein an end of said extension is maintained in a folded condition when said locking member locks said force applying portion.

49. A container according to any one of claims 43 through 48, wherein said toner receiving container comprises an opening for receiving the toner supplied from said toner supplying container and a covering member for covering said opening, wherein a covering member of said toner supplying container comprises an engaging portion for engagement with said covering member of said toner receiving container to open said covering member of said toner receiving container in interrelation with said opening of said covering member of said toner supplying container after said toner supplying container is mounted to the image forming apparatus.

50. A toner receiving container for receiving toner from a toner supplying container, comprising:

a mounting portion for mounting a toner supplying container including:

a container body for accommodating toner, said container body being provided with an opening for permitting supply of the toner into a toner receiving container;

a sealing member for sealing said opening;

a grip portion for applying a force to said sealing member to open said opening;

a releasable locking member for releasably locking said grip portion at a predetermined position of said container body, wherein said releasable locking member releases said grip portion by a releasing portion of the image forming apparatus when said toner supply container is mounted to the image forming apparatus; and a releasing member for releasing said locking member from said predetermined position when said toner supplying container is mounted to said mounting portion.

51. A container according to claim 50, further comprising a toner receiving opening for receiving the toner from said toner supplying container, and a cover member for covering said opening, and wherein said releasing member is provided in said cover member of said toner receiving container.

52. A container according to claim 51, wherein said toner supplying container comprises a covering member for covering said opening of said toner supplying container, wherein said covering member of said toner receiving container comprises an engaging portion for engagement with the covering member of said toner supplying container to open said covering member of said toner receiving container in interrelation with said opening of said covering member of said toner supplying container after said toner supplying container is mounted to the image forming apparatus.

53. A container according to claim 50, wherein said toner supplying container comprises a covering member for covering said opening of said toner supplying container, wherein said covering member of said toner receiving container comprises an engaging portion for engagement with said covering member of said toner supplying container to open said covering member of said toner receiving container in interrelation with the opening of said covering member of said toner supplying container after said toner supplying container is mounted to the image forming apparatus.

* * * * *

UNITED STATES PATENT AND TRADEMARK OFFICE

CERTIFICATE OF CORRECTION

PATENT NO. : 6,289,193 B1
DATED : September 11, 2001
INVENTOR(S) : Yutaka Ban et al.

It is certified that error appears in the above-identified patent and that said Letters Patent is hereby corrected as shown below:

Title page,
Item [57], ABSTRACT,
Line 6, “is” should read -- being --; and
Line 10, “a” should read -- and a --.

Column 1,
Line 63, “propouses” should read -- proposes --.

Column 2,
Line 1, “member” should read -- member, --;
Line 12, “an” should read -- a --;
Line 13, “operation,” should read -- operation. --;
Line 26, “mount ed” should read -- mounted --;
Line 31, “t he” should read -- the --; and
Line 40, “Figures” should read -- The following figures --.

Column 3,
Line 28, “FIG. 23 is a perspective view” should read -- FIGS. 23(*a*), 23(*b*), 23(*c*) and 23(*d*) are perspective views; and
Line 55, “the unsealing operation. Figs. 17(*a*)” should read -- FIGS. 17(*a*), --.

Column 4,
Line 13, “flange 3*ff*” should read -- flange 3*ff* (front side) --;
Line 20, “3, 3,” should read -- 3, -- and “wall 3*al*” should read -- 3*a*1 --; and
Line 61, “film-like 5” should read -- film-like sheet 5 --.

Column 5,
Line 1, “container of the” should be deleted;
Line 14, “rest” should read -- remaining --;
Line 29, “scattering” should read -- by scattering --;
Line 35, “sides (3*ff*) of the front part flange 3*f*” should read -- sides of the front part of flange 3*ff* --; and
Line 67, “recess (groove) 6*d*” should read -- recess (groove) 6*d* --.

Column 6,
Line 4, “is” should be deleted;
Lines 8, 11, 12 and 15, “york” should read -- yoke --; and
Line 23, “(york)” should read -- (yoke) --.

UNITED STATES PATENT AND TRADEMARK OFFICE

CERTIFICATE OF CORRECTION

PATENT NO. : 6,289,193 B1
DATED : September 11, 2001
INVENTOR(S) : Yutaka Ban et al.

It is certified that error appears in the above-identified patent and that said Letters Patent is hereby corrected as shown below:

Column 7,
Line 42, “By” should read -- When --.

Column 8,
Line 14, “FIG.” should read -- Figure -- and “member(leaf spring) 9” should read -- member (leaf spring) 9 --.

Column 9,
Line 11, “destroyed” should read -- leveled --.

Column 10,
Line 36, “of FIG. 23,” should be deleted;
Line 41, “string 5” should read -- string 15 --;
Line 61, “is” should read -- being --; and
Line 67, “member and;” should read -- member; and --.

Column 11,
Line 3, “elastic” should read -- an elastic --; and
Line 58, “container” should read -- a container --.

Column 13,
Line 41, “cover member” should be deleted.

Column 14,
Line 11, “force applying” should read -- grip --;
Line 41, “toner,” should read -- toner --; and
Line 67, “cover member” should be deleted.

Column 15,
Line 13, “supply” should read -- supplying --; and
Line 31, “force applying” should read -- grip --.

UNITED STATES PATENT AND TRADEMARK OFFICE

CERTIFICATE OF CORRECTION

PATENT NO. : 6,289,193 B1
DATED : September 11, 2001
INVENTOR(S) : Yutaka Ban et al.

It is certified that error appears in the above-identified patent and that said Letters Patent is hereby corrected as shown below:

Column 16,
Line 12, "supply" should read -- supplying --.

Signed and Sealed this

Tenth Day of September, 2002

*Attest:*

*Attesting Officer*

JAMES E. ROGAN
*Director of the United States Patent and Trademark Office*